US011715421B2

(12) United States Patent
Kim

(10) Patent No.: US 11,715,421 B2
(45) Date of Patent: Aug. 1, 2023

(54) PIXEL AND DISPLAY DEVICE INCLUDING PIXEL

(71) Applicant: Samsung Display Co., Ltd., Yongin-Si (KR)

(72) Inventor: Keunwoo Kim, Seongnam-si (KR)

(73) Assignee: Samsung Display Co., Ltd., Yongin-Si (KR)

( * ) Notice: Subject to any disclaimer, the term of this patent is extended or adjusted under 35 U.S.C. 154(b) by 0 days.

(21) Appl. No.: 17/939,721

(22) Filed: Sep. 7, 2022

(65) Prior Publication Data

US 2023/0103495 A1 Apr. 6, 2023

(30) Foreign Application Priority Data

Oct. 6, 2021 (KR) ..... 10-2021-0132332

(51) Int. Cl.
*G09G 3/3233* (2016.01)

(52) U.S. Cl.
CPC ... *G09G 3/3233* (2013.01); *G09G 2300/0819* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 2017/0124954 | A1* | 5/2017 | Park | G09G 3/3258 |
| 2018/0130420 | A1* | 5/2018 | Gao | G09G 3/3258 |
| 2021/0104194 | A1 | 4/2021 | Kim et al. | |
| 2021/0319747 | A1* | 10/2021 | Jeon | G09G 3/3233 |
| 2022/0238070 | A1 | 7/2022 | Kim | |

FOREIGN PATENT DOCUMENTS

| | | | |
|---|---|---|---|
| CN | 111508435 | A | 8/2020 |
| CN | 112259050 | A | 1/2021 |
| CN | 114822410 | A | 7/2022 |
| EP | 4036904 | A1 | 8/2022 |
| KR | 10-2020-0015862 | A | 2/2020 |

* cited by examiner

*Primary Examiner* — Nicholas J Lee
(74) *Attorney, Agent, or Firm* — Innovation Counsel LLP

(57) ABSTRACT

A pixel includes an organic light emitting diode that is configured to output light based on a driving current, and includes a first terminal and a second terminal. A driving transistor is configured to generate the driving current, and includes a first terminal to which a first power supply voltage and a bias power supply voltage are applied, a second terminal connected to the first terminal of the organic light emitting diode, and a gate terminal to which a first initialization voltage is applied. The first dual gate transistor is connected between the gate terminal of the driving transistor and the second terminal of the driving transistor. The first switching transistor includes a first terminal to which the bias power supply voltage is applied, a second terminal connected to the first terminal of the driving transistor, and a gate terminal to which a light emitting diode initialization signal is applied.

20 Claims, 11 Drawing Sheets

PIXEL AND DISPLAY DEVICE INCLUDING PIXEL

CROSS-REFERENCE TO RELATED APPLICATION

This application claims priority under 35 USC § 119 to Korean Patent Application No. 10-2021-0132332 filed on Oct. 6, 2021 in the Korean Intellectual Property Office (KIPO), the entire disclosure of which is incorporated herein by reference.

BACKGROUND

1. Field

Embodiments relate generally to a pixel and a display device. More particularly, embodiments of the present disclosure relate to a pixel and a display device including a pixel.

2. Description Of The Related Art

Flat panel display devices are used as display devices for replacing a cathode ray tube display device due to lightweight and thin characteristics thereof. Examples of such flat panel display devices include a liquid crystal display device, an organic light emitting display device, a quantum dot display device, and the like.

Recently, a display device that may be driven at different frequencies has been developed. Such a display device may correspond to a display device with a high specification (e.g., high end). In order to increase efficiency of a battery included in the display device, power consumption of pixels included in the display device is lowered. In order to reduce the power consumption of the pixels, a low-frequency driving technology for reducing a driving frequency for the pixels when the pixels display a still image (or when the pixels are driven at a low frequency) has been developed. However, while the pixels display an image based on data signals, the data signals may be distorted by a leakage current or the like of transistors included in the pixels, and image quality of the display device may deteriorate.

SUMMARY

A pixel is disclosed.

A display device including a pixel is disclosed.

According to an aspect of the present disclosure, a pixel includes an organic light emitting diode, a driving transistor, a first dual gate transistor, a first switching transistor, and, a second switching transistor. The organic light emitting diode is configured to output a light based on a driving current, and includes a first terminal and a second terminal. The driving transistor is configured to generate the driving current, and includes a first terminal to which a first power supply voltage and a bias power supply voltage are applied, a second terminal connected to the first terminal of the organic light emitting diode, and a gate terminal to which a first initialization voltage is applied. The first dual gate transistor is connected between the gate terminal of the driving transistor and the second terminal of the driving transistor, and includes a first sub-transistor and a second sub-transistor, which are connected in series. The first switching transistor includes a first terminal to which the bias power supply voltage is applied, a second terminal connected to the first terminal of the driving transistor, and a gate terminal to which a light emitting diode initialization signal is applied. The second switching transistor includes a first terminal connected to the second terminal of the first switching transistor, a second terminal connected to a first node that connects the first and second sub-transistors to each other, and a gate terminal to which the first power supply voltage is applied.

Optionally, the second switching transistor may be configured to reduce a voltage level of the bias power supply voltage to provide a power supply voltage, which has a voltage level that is lower than the voltage level of the bias power supply voltage, to the first node.

The first switching transistor may be configured to provide the bias power supply voltage to the first terminal of the driving transistor in response to the light emitting diode initialization signal, and the driving transistor to which the bias power supply voltage is applied may be in an on-bias state.

The first dual gate transistor may include a gate terminal to which a compensation gate signal is applied, and the compensation gate signal may be driven at a first frequency. The light emitting diode initialization signal may be driven at a second frequency that is different from the first frequency, and the second frequency may be higher than the first frequency.

The pixel may further include a third switching transistor including a first terminal to which a second initialization voltage is applied, a second terminal connected to the first terminal of the organic light emitting diode, and a gate terminal to which the light emitting diode initialization signal is applied.

The pixel may further include a fourth switching transistor including a first terminal to which a data voltage is applied, a second terminal connected to the first terminal of the driving transistor, and a gate terminal to which a data write gate signal is applied.

The pixel may further include a storage capacitor, a fifth switching transistor, and a sixth switching transistor. The storage capacitor may include a first terminal to which the first power supply voltage is applied and a second terminal connected to the gate terminal of the driving transistor. The fifth switching transistor may include a first terminal connected to a first power supply voltage line to which the first power supply voltage is applied, a second terminal connected to the first terminal of the driving transistor, and a gate terminal to which an emission signal is applied. The sixth switching transistor may include a first terminal connected to the second terminal of the driving transistor, a second terminal connected to the first terminal of the organic light emitting diode, and a gate terminal to which the emission signal is applied.

The first dual gate transistor may include a gate terminal to which a compensation gate signal is applied, and the emission signal and the compensation gate signal may be driven at a same frequency.

The pixel may further include a second dual gate transistor connected between the first sub-transistor and an initialization voltage line to which the first initialization voltage is provided, and may include a third sub-transistor and a fourth sub-transistor, which are connected in series.

The second terminal of the second switching transistor may be additionally connected to a second node that connects the third and fourth sub-transistors to each other.

The second switching transistor may be configured to reduce a voltage level of the bias power supply voltage to provide a power supply voltage, which has a voltage level that is lower than the voltage level of the bias power supply voltage, to the second node.

The pixel may further include a seventh switching transistor connected between the first switching transistor and the second switching transistor. The first power supply voltage may be applied to a gate terminal of the seventh switching transistor.

The second and seventh switching transistors may be configured to reduce a voltage level of the bias power supply voltage to provide a power supply voltage, which has a voltage level that is lower than the voltage level of the bias power supply voltage, to the first node.

The first dual gate transistor may diode-connect the driving transistor in response to a compensation gate signal.

According to another aspect of the present disclosure, a display device includes a display panel including a pixel, a gate driver, and an emission driver. The gate driver is configured to generate a data write gate signal, a data initialization gate signal, and a compensation gate signal to provide the data write gate signal, the data initialization gate signal, and the compensation gate signal to the pixel, and is driven at a first frequency. The emission driver is configured to generate an emission signal to provide the emission signal to the pixel, and is driven at a second frequency that is different from the first frequency. The pixel includes an organic light emitting diode, a driving transistor, a first dual gate transistor, a first switching transistor, and, a second switching transistor. The organic light emitting diode is configured to output a light based on a driving current, and includes a first terminal and a second terminal. The driving transistor is configured to generate the driving current, and includes a first terminal to which a first power supply voltage and a bias power supply voltage are applied, a second terminal connected to the first terminal of the organic light emitting diode, and a gate terminal to which a first initialization voltage is applied. The first dual gate transistor is connected between the gate terminal of the driving transistor and the second terminal of the driving transistor, and includes a first sub-transistor and a second sub-transistor, which are connected in series. The first switching transistor includes a first terminal to which the bias power supply voltage is applied, a second terminal connected to the first terminal of the driving transistor, and a gate terminal to which a light emitting diode initialization signal is applied. The second switching transistor includes a first terminal connected to the second terminal of the first switching transistor, a second terminal connected to a first node that connects the first and second sub-transistors to each other, and a gate terminal to which the first power supply voltage is applied.

The display device may further include an initialization driver. The initialization driver may be configured to generate the light emitting diode initialization signal to provide the light emitting diode initialization signal to the pixel, and may be driven at the second frequency. The second frequency may be higher than the first frequency.

The pixel may further include a third switching transistor including a first terminal to which a second initialization voltage is applied, a second terminal connected to the first terminal of the organic light emitting diode, and a gate terminal to which the light emitting diode initialization signal is applied, a fourth switching transistor including a first terminal to which a data voltage is applied, a second terminal connected to the first terminal of the driving transistor, and a gate terminal to which the data write gate signal is applied, a storage capacitor including a first terminal to which the first power supply voltage is applied and a second terminal connected to the gate terminal of the driving transistor, a fifth switching transistor including a first terminal connected to a first power supply voltage line to which the first power supply voltage is applied, a second terminal connected to the first terminal of the driving transistor, and a gate terminal to which the emission signal is applied, and a sixth switching transistor including a first terminal connected to the second terminal of the driving transistor, a second terminal connected to the first terminal of the organic light emitting diode, and a gate terminal to which the emission signal is applied.

The pixel further may include a second dual gate transistor. The second dual gate transistor may be connected between the first sub-transistor and an initialization voltage line to which the first initialization voltage is provided, and may include a third sub-transistor and a fourth sub-transistor, which are connected in series.

The second terminal of the second switching transistor may be additionally connected to a second node that connects the third and fourth sub-transistors to each other.

In embodiments, the pixel further may include a seventh switching transistor connected between the first switching transistor and the second switching transistor, and the first power supply voltage may be applied to a gate terminal of the seventh switching transistor.

Since the display device according to the present disclosure includes the eighth transistor, the luminance of the organic light emitting diode may not be decreased when the pixel is driven with low and middle gray levels in the low-frequency driving of the display device. In addition, since the display device includes the ninth transistor, the luminance of the organic light emitting diode may not be decreased in a case of driving with a high gray level in the low-frequency driving of the display device. Accordingly, when the display device is driven at a low frequency, the display device may be driven without the decrease in the luminance of the organic light emitting diode in all gray levels.

In addition, since the display device according to the present disclosure includes the ninth transistor and the tenth transistor connected in series between the eighth transistor and the first node, even when the bias power supply voltage has a relatively higher voltage level, the preset voltage may be provided to the first node. Accordingly, when the display device is driven at a low frequency, the display device may be driven without the decrease in the luminance of the organic light emitting diode in all gray levels.

Further, since the display device according to the embodiments of the present disclosure includes the eighth transistor and the ninth transistor, the hysteresis of the first transistor may be reduced, and the voltage of each of the first and second nodes may be prevented from increasing so that the flicker phenomenon may be further reduced. Accordingly, when the display device is driven at a low frequency, the display device may be driven without the decrease in the luminance of the organic light emitting diode in all gray levels.

BRIEF DESCRIPTION OF THE DRAWINGS

Embodiments can be understood in more detail from the following description taken in conjunction with the accompanying drawings.

DETAILED DESCRIPTION OF THE EMBODIMENTS

Figure 1:
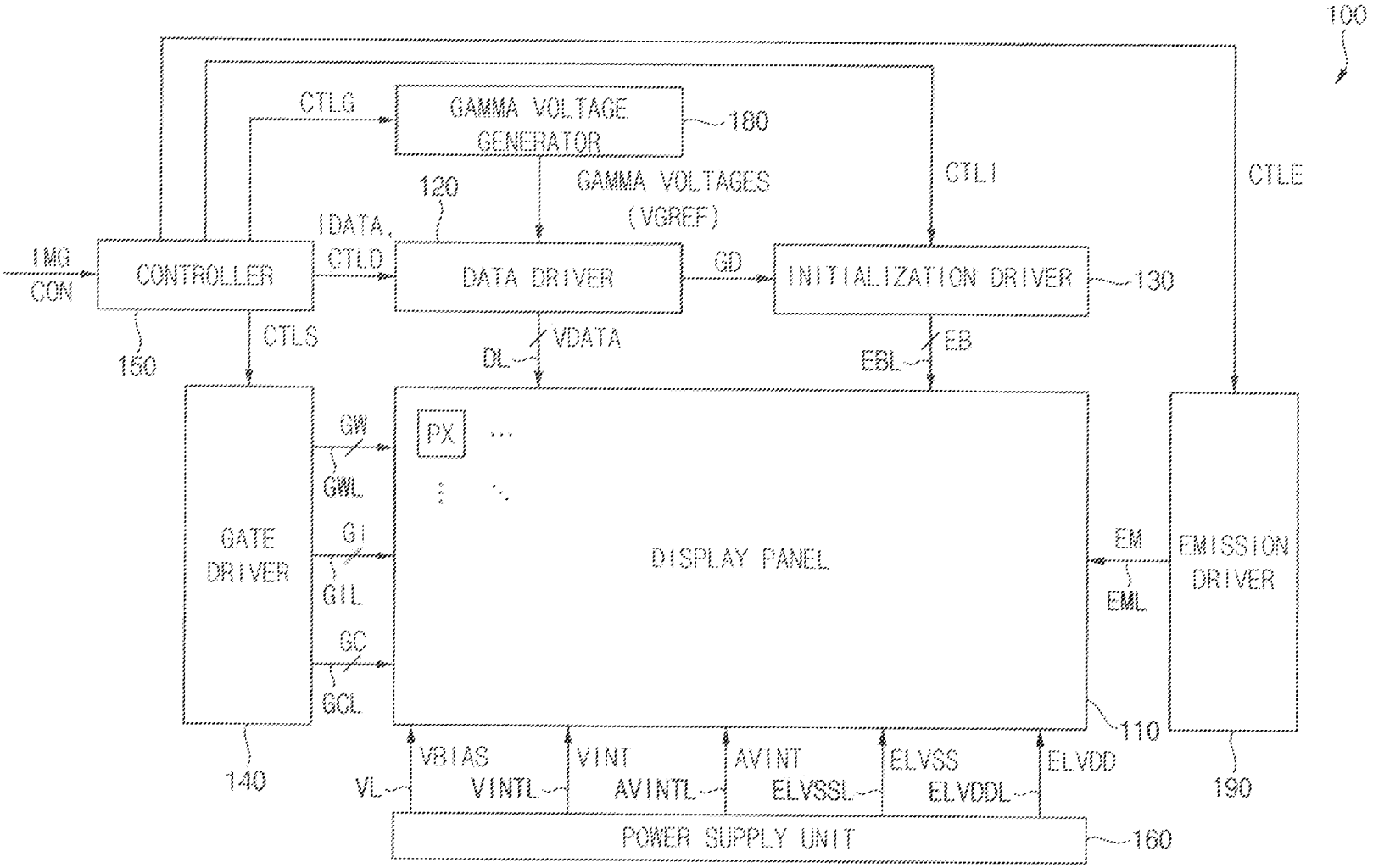
FIG. 1 is a block diagram showing a display device according to embodiments of the present disclosure.

Hereinafter, pixels and display devices according to embodiments of the present disclosure will be described in detail with reference to the accompanying drawings. In the accompanying drawings, same or similar reference numerals refer to the same or similar elements.

FIG. 1 is a block diagram showing a display device according to embodiments of the present disclosure.

Referring to FIG. 1, a display device 100 may include a display panel 110 including a plurality of pixels PX, a controller 150, a data driver 120, a gate driver 140, an emission driver 190, a power supply unit 160, a gamma reference voltage generator 180, an initialization driver 130, and the like.

The display panel 110 may include a plurality of data lines DL, a plurality of data write gate lines GWL, a plurality of data initialization gate lines GIL, a plurality of compensation gate lines GCL, a plurality of emission lines EML, a plurality of light emitting diode initialization lines EBL, a plurality of first power supply voltage lines ELVDDL, a plurality of second power supply voltage lines ELVSSL, a plurality of first initialization voltage lines VINTL, a plurality of second initialization voltage lines AVINTL, a plurality of bias power supply voltage lines VL, and a plurality of pixels PX connected to the lines.

According to some embodiments, each of the pixels PX may include at least two transistors, at least one capacitor, and a light emitting element, and the display panel 110 may be a light emitting display panel. According to some embodiments, the display panel 110 may be a display panel of an organic light emitting display device (OLED). According to other embodiments, the display panel 110 may include a display panel of a quantum dot display device (QDD), a display panel of a liquid crystal display device (LCD), a display panel of a field emission display device (FED), a display panel of a plasma display device (PDP), or a display panel of an electrophoretic display device (EPD).

The controller 150 (e.g., a timing controller (T-CON)) may receive image data IMG and an input control signal CON from an external host processor (e.g., an application processor (AP), a graphic processing unit (GPU), or a graphic card). The image data IMG may be RGB image data including red image data, green image data, and blue image data. In addition, the image data IMG may include information on a driving frequency. The control signal CON may include a vertical synchronization signal, a horizontal synchronization signal, an input data enable signal, a master clock signal, and the like, but the embodiments are not limited thereto.

The controller 150 may convert the image data IMG into input image data IDATA by applying a modification (e.g., dynamic capacitance compensation (DCC), etc.) for correcting image quality to the image data IMG supplied from the external host processor. In some embodiments, when the controller 150 does not include a modification method for improving image quality, the image data IMG may be output as the input image data IDATA. The controller 150 may supply the input image data IDATA to the data driver 120.

The controller 150 may generate a data control signal CTLD for controlling an operation of the data driver 120, a gate control signal CTLS for controlling an operation of the gate driver 140, an emission control signal CTLE for controlling an operation of the emission driver 190, a gamma control signal CTLG for controlling an operation of the gamma reference voltage generator 180, and an initialization control signal CTLI for controlling an operation of the initialization driver 130 based on the input control signal CON. For example, the gate control signal CTLS may include a vertical start signal, gate clock signals, and the like, and the data control signal CTLD may include a horizontal start signal, a data clock signal, and the like.

The gate driver 140 may generate data write gate signals GW, data initialization gate signals GI, and compensation gate signals GC based on the gate control signal CTLS received from the controller 150. The gate driver 140 may output the data write gate signals GW, the data initialization gate signals GI, and the compensation gate signals GC to the pixels PX connected to the data write gate lines GWL, the data initialization gate lines GIL, and the compensation gate lines GCL.

The emission driver 190 may generate emission signals EM based on the emission control signal CTLE received from the controller 150. The emission driver 190 may output the emission signals EM to the pixels PX connected to the emission lines EML.

The initialization driver 130 may generate light emitting diode initialization signals EB based on the initialization control signal CTLI received from the controller 150. The initialization driver 130 may output the light emitting diode initialization signals EB to the pixel PX connected to the light emitting diode initialization lines EBL. In some embodiments, the initialization driver 130 may be formed integrally with the gate driver 140 or the emission driver 190.

The power supply unit 160 may generate a bias power supply voltage VBIAS, a first initialization voltage VINT, a second initialization voltage AVINT, a first power supply voltage ELVDD, and a second power supply voltage ELVSS, and may provide the bias power supply voltage VBIAS, the first initialization voltage VINT, the second initialization voltage AVINT, the first power supply voltage ELVDD, and the second power supply voltage ELVSS to the pixels PX through the bias power supply voltage line VL, the first initialization voltage line VINTL, the second initialization voltage line AVINTL, the first power supply voltage line ELVDDL, and the second power supply voltage line ELVSSL.

The display device 100 using the bias power supply voltage VBIAS may correspond to a display device 100 with a high specification (e.g., high end). For example, in general, a display device may display an image at a fixed frame frequency (or a constant refresh rate) such as about 60 Hz, about 120 Hz, or about 240 Hz. However, a frame frequency of rendering performed by the host processor (e.g., the GPU or the graphic card) configured to provide frame data to the display device 100 according to the present disclosure may not match a frame frequency of the display device 100. In particular, when the host processor provides frame data for a game image on which complex rendering is performed to the display device 100, a frame frequency mismatch (i.e., a latency difference) may occur. To solve the above problem, the bias power supply voltage VBIAS may be additionally provided to the display device 100.

The gamma reference voltage generator 180 may generate a gamma reference voltage VGREF based on the gamma control signal CTLG received from the controller 150. The gamma reference voltage generator 180 may provide the gamma reference voltage VGREF to the data driver 120. The gamma reference voltage VGREF provided to the data driver 120 may have a value corresponding to each input image data IDATA. In some embodiments, the gamma reference voltage generator 180 may be formed integrally with the data driver 120 or the controller 150.

The data driver 120 may receive the data control signal CTLD and the input image data IDATA from the controller 150, and may receive the gamma reference voltage VGREF from the gamma reference voltage generator 180. The data driver 120 may convert digital input image data IDATA into an analog data voltage by using the gamma reference voltage VGREF. In this case, the analog data voltage obtained by the conversion will be defined as a data voltage VDATA. The data driver 120 may output data voltages VDATA to the pixels PX connected to the data lines DL based on the data control signal CTLD. According to other embodiments, the data driver 120 and the controller 150 may be implemented as a single integrated circuit, and such an integrated circuit may be referred to as a timing controller-embedded data driver (TED).

Figure 2:
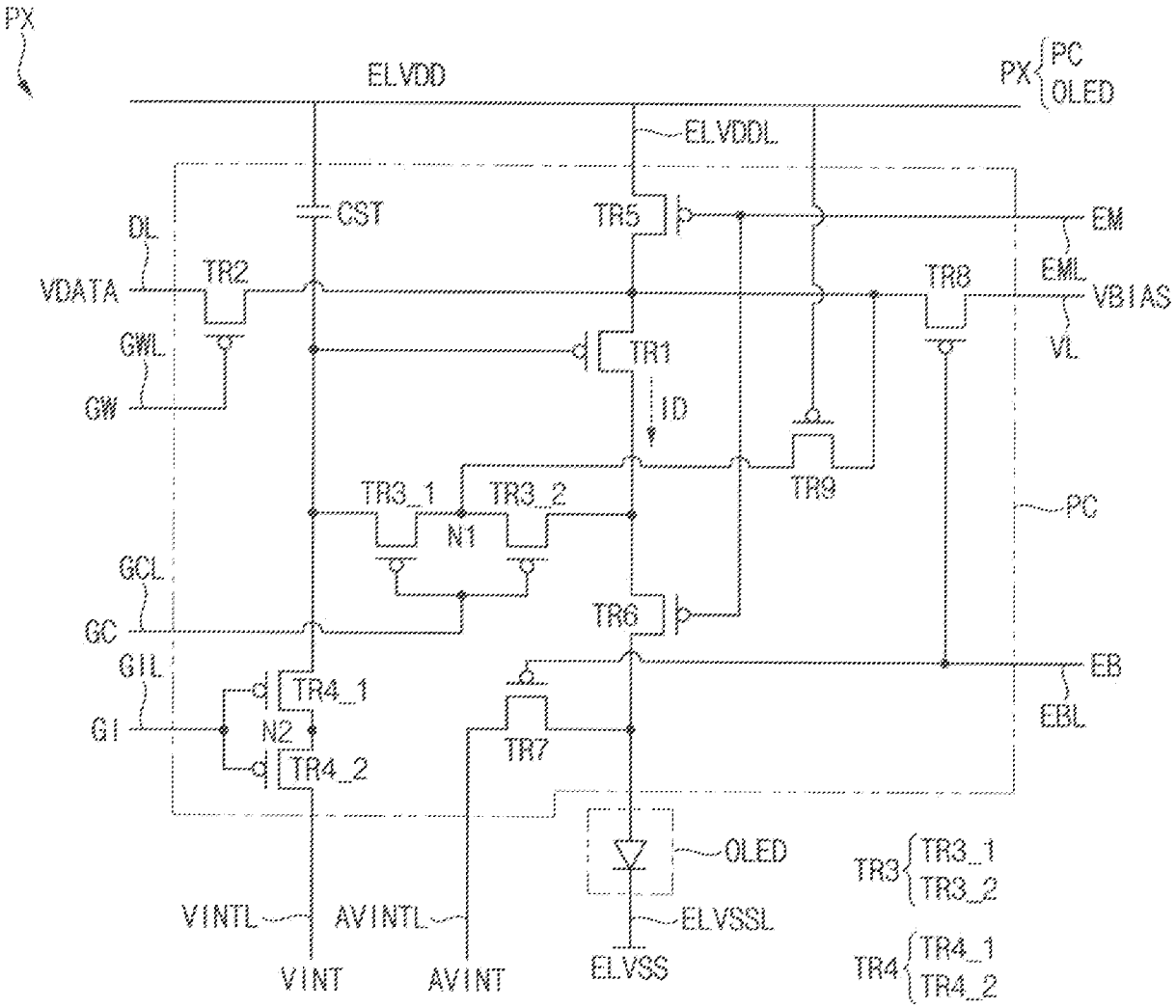
FIG. 2 is a circuit diagram showing a pixel included in FIG. 1.

FIG. 2 is a circuit diagram showing a pixel included in FIG. 1.

Referring to FIG. 2, the display device 100 may include a pixel PX, and the pixel PX may include a pixel circuit PC and an organic light emitting diode OLED. In this case, the pixel circuit PC may include first to ninth transistors TR1, TR2, TR3, TR4, TR5, TR6, TR7, TR8, and TR9, a storage capacitor CST, and the like. In addition, the pixel circuit PC or the organic light emitting diode OLED may be connected to the bias power supply voltage line VL, the first power supply voltage line ELVDDL, the second power supply voltage line ELVSSL, the first initialization voltage line VINTL, the second initialization voltage line AVINTL, the light emitting diode initialization line EBL, the data line DL, the data write gate line GWL, the data initialization gate line GIL, the compensation gate line GCL, the emission line EML, and the like. The first transistor TR1 may correspond to a driving transistor, and the second to ninth transistors TR2, TR3, TR4, TR5, TR6, TR7, TR8, and TR9 may correspond to switching transistors. Each of the first to ninth transistors TR1, TR2, TR3, TR4, TR5, TR6, TR7, TR8, and TR9 may include a first terminal, a second terminal, and a gate terminal. According to the embodiments, the first terminal may be a source terminal, and the second terminal may be a drain terminal. In some embodiments, the first terminal may be a drain terminal, and the second terminal may be a source terminal.

According to the embodiments, each of the first to ninth transistors TR1, TR2, TR3, TR4, TR5, TR6, TR7, TR8, and TR9 may be a PMOS transistor, and may have a channel including polysilicon. According to other embodiments, each of the first to ninth transistors TR1, TR2, TR3, TR4, TR5, TR6, TR7, TR8, and TR9 may be an NMOS transistor, and may have a channel including a metal oxide semiconductor. According to still other embodiments, each of the first, second, and fifth to ninth transistors TR1, TR2, TR5, TR6, TR7, TR8, and TR9 may be a PMOS transistor, and each of the third and fourth transistors TR3 and TR4 may be an NMOS transistor.

The organic light emitting diode OLED may output a light based on a driving current ID. The organic light emitting diode OLED may include a first terminal and a second terminal. According to some embodiments, the second terminal of the organic light emitting diode OLED may receive the second power supply voltage ELVSS, and the first terminal of the organic light emitting diode OLED may receive the first power supply voltage ELVDD. In this case, the first power supply voltage ELVDD and the second power supply voltage ELVSS may be provided from the power supply unit 160 through the first power supply voltage line ELVDDL and the second power supply voltage line ELVSSL, respectively. For example, the first terminal of the organic light emitting diode OLED may be an anode terminal, and the second terminal of the organic light emitting diode OLED may be a cathode terminal. In some embodiments, the first terminal of the organic light emitting diode OLED may be a cathode terminal, and the second terminal of the organic light emitting diode OLED may be an anode terminal.

The first power supply voltage ELVDD and the bias power supply voltage VBIAS may be applied to the first terminal of the first transistor TR1. The second terminal of the first transistor TR1 may be connected to the first terminal of the organic light emitting diode OLED. The first initialization voltage VINT may be applied to the gate terminal of the first transistor TR1. In this case, the bias power supply voltage VBIAS and the first initialization voltage VINT may be provided from the power supply unit 160 through the bias power supply voltage line VL and the first initialization voltage line VINTL, respectively.

The first transistor TR1 may generate the driving current ID. According to the embodiments, the first transistor TR1 may operate in a saturation region. In this case, the first transistor TR1 may generate the driving current ID based on a voltage difference between the gate terminal and the source terminal of the first transistor TR1. In addition, gray levels may be expressed based on a magnitude of the driving current ID supplied to the organic light emitting diode OLED. In some embodiments, the first transistor TR1 may operate in a linear region. In this case, the gray levels may be expressed based on a sum of a time during which the driving current is supplied to the organic light emitting diode OLED within one frame.

The gate terminal of the second transistor TR2 (e.g., a fourth switching transistor) may receive the data write gate signal GW. In this case, the data write gate signal GW may be provided from the gate driver 140 through the data write gate line GWL. The first terminal of the second transistor TR2 may receive the data voltage VDATA. In this case, the data voltage VDATA may be provided from the data driver 120 through the data line DL. The second terminal of the second transistor TR2 may be connected to the first terminal of the first transistor TR1. The second transistor TR2 may supply the data voltage VDATA to the first terminal of the first transistor TR1 during an activation period of the data write gate signal GW. In this case, the second transistor TR2 may operate in a linear region.

The gate terminal of the third transistor TR3 may receive the compensation gate signal GC. In this case, the compensation gate signal GC may be provided from the gate driver 140 through the compensation gate line GCL. The first terminal of the third transistor TR3 may be connected to the gate terminal of the first transistor TR1. The second terminal of the third transistor TR3 may be connected to the second terminal of the first transistor TR1. In other words, the third transistor TR3 may be connected between the gate terminal of the first transistor TR1 and the second terminal of the first transistor TR1.

The third transistor TR3 may connect the gate terminal of the first transistor TR1 to the second terminal of the first transistor TR1 during an activation period of the compensation gate signal GC. In this case, the third transistor TR3 may operate in a linear region. That is, the third transistor TR3 may diode-connect the first transistor TR1 during the activation period of the compensation gate signal GC. In other words, the third transistor TR3 may diode-connect the first transistor TR1 in response to the compensation gate signal GC. Since the first transistor TR1 is diode-connected, a voltage difference corresponding to a threshold voltage of the first transistor TR1 may occur between the first terminal of the first transistor TR1 and the gate terminal of the first transistor TR1. In this case, the threshold voltage may have a negative value. As a result, a voltage obtained by summing up the data voltage VDATA supplied to the first terminal of the first transistor TR1 and the voltage difference (i.e., the threshold voltage) may be supplied to the gate terminal of the first transistor TR1 during the activation period of the data write gate signal GW. In other words, the data voltage VDATA may be compensated for by the threshold voltage of the first transistor TR1, and the compensated data voltage VDATA may be supplied to the gate terminal of the first transistor TR1.

According to the disclosure, the third transistor TR3 may be defined as a first dual gate transistor (or a double gate transistor, a dual gate transistor, etc.). The first dual gate transistor may include a first sub-transistor TR3_1 and a second sub-transistor TR3_2. The first sub-transistor TR3_1 and the second sub-transistor TR3_2 may be connected in series, and a first node N1 may connect the first sub-transistor TR3_1 and the second sub-transistor TR3_2 to each other. In other words, the third transistor TR3 may operate as a dual gate transistor, and the same signal may be applied to a gate terminal of each of the first and second sub-transistors TR3_1 and TR3_2. Therefore, the gate electrode of each of the first and second sub-transistors TR3_1 and TR3_2 may receive the compensation gate signal GC. In addition, a second terminal of the first sub-transistor TR3_1 and a first terminal of the second sub-transistor TR3_2 may be connected to each other.

The gate terminal of the fourth transistor TR4 may receive the data initialization gate signal GI. In this case, the data initialization gate signal GI may be provided from the gate driver 140 through the data initialization gate line GIL. The first terminal of the fourth transistor TR4 may receive the first initialization voltage VINT. The second terminal of the fourth transistor TR4 may be connected to the gate terminal of the first transistor TR1. In other words, the fourth transistor TR4 may be connected between the first sub-transistor TR3_1 and the first initialization voltage line VINTL.

The fourth transistor TR4 may supply the first initialization voltage VINT to the gate terminal of the first transistor TR1 during an activation period of the data initialization gate signal GI. In this case, the fourth transistor TR4 may operate in a linear region. In other words, the fourth transistor TR4 may initialize the gate terminal of the first transistor TR1 to the first initialization voltage VINT during the activation period of the data initialization gate signal GI. According to the embodiments, the first initialization voltage VINT may have a voltage level that is sufficiently lower than a voltage level of the data voltage VDATA maintained by the storage capacitor CST in a previous frame, and the first initialization voltage VINT may be supplied to the gate terminal of the first transistor TR1. According to other embodiments, the first initialization voltage VINT may have a voltage level that is sufficiently higher than the voltage level of the data voltage VDATA maintained by the storage capacitor CST in the previous frame, and the first initialization voltage VINT may be supplied to the gate terminal of the first transistor TR1. According to the embodiments, the data initialization gate signal GI may be substantially the same as the data write gate signal GW of one horizontal time before. For example, the data initialization gate signal GI supplied to the pixels PX in an $n^{th}$ row (where n is an integer that is greater than or equal to 2) among the pixels PX included in the display device 100 may be a signal that is substantially the same as the data write gate signal GW supplied to pixels PX in an $(n-1)^{th}$ row among the pixels PX. In other words, an activated data write gate signal GW may be supplied to the pixels PX in the $(n-1)^{th}$ row among the pixels PX, so that an activated data initialization gate signal GI may be supplied to the pixels PX in the $n^{th}$ row among the pixels PX. As a result, the data voltage VDATA may be supplied to the pixels PX in the $(n-1)^{th}$ row among the pixels PX, and simultaneously, the gate terminal of the first transistor TR1 included in the pixels PX in the $n^{th}$ row among the pixels PX may be initialized to the first initialization voltage VINT.

According to the disclosure, the fourth transistor TR4 may be defined as a second dual gate transistor (or a double gate transistor, a dual gate transistor, etc.). The second dual gate transistor may include a third sub-transistor TR4_1 and a fourth sub-transistor TR4_2. The third sub-transistor TR4_1 and the fourth sub-transistor TR4_2 may be connected in series, and a second node N2 may connect the third sub-transistor TR4_1 and the fourth sub-transistor TR4_2 to each other. In other words, the fourth transistor TR4 may operate as a dual gate transistor, and the same signal may be applied to a gate terminal of each of the third and fourth sub-transistors TR4_1 and TR4_2. Therefore, the gate electrode of each of the third and fourth sub-transistors TR4_1 and TR4_2 may receive the data initialization gate signal GI. In addition, a second terminal of the third sub-transistor TR4_1 and a first terminal of the fourth sub-transistor TR4_2 may be connected to each other.

The gate terminal of the fifth transistor TR5 (e.g., a fifth switching transistor) may receive the emission signal EM. In this case, the emission signal EM may be provided from the emission driver 190 through the emission line EML. The first terminal of the fifth transistor TR5 may receive the first power supply voltage ELVDD. The second terminal of the fifth transistor TR5 may be connected to the first terminal of the first transistor TR1. The fifth transistor TR5 may supply the first power supply voltage ELVDD to the first terminal of the first transistor TR1 during an activation period of the emission signal EM. On the contrary, the fifth transistor TR5 may cut off the supply of the first power supply voltage ELVDD during an inactivation period of the emission signal EM. In this case, the fifth transistor TR5 may operate in a linear region. Since the fifth transistor TR5 supplies the first power supply voltage ELVDD to the first terminal of the first transistor TR1 during the activation period of the emission signal EM, the first transistor TR1 may generate the driving current ID. In addition, since the fifth transistor TR5 cuts off the supply of the first power supply voltage ELVDD during the inactivation period of the emission signal EM, the data voltage VDATA supplied to the first terminal of the first transistor TR1 may be supplied to the gate terminal of the first transistor TR1.

The gate terminal of the sixth transistor TR6 (e.g., a sixth switching transistor) may receive the emission signal EM. The first terminal of the sixth transistor TR6 may be connected to the second terminal of the first transistor TR1. The second terminal of the sixth transistor TR6 may be connected to the first terminal of the organic light emitting diode OLED. The sixth transistor TR6 may supply the driving current ID generated by the first transistor TR1 to the organic light emitting diode OLED during the activation period of the emission signal EM. In this case, the sixth transistor TR6 may operate in a linear region. In other words, since the sixth transistor TR6 supplies the driving current ID generated by the first transistor TR1 to the organic light emitting diode OLED during the activation period of the emission signal EM, the organic light emitting diode OLED may output light. In addition, since the sixth transistor TR6 electrically separates the first transistor TR1 and the organic light emitting diode OLED from each other during the inactivation period of the emission signal EM, the data voltage VDATA supplied to the second terminal of the first transistor TR1 (e.g., a data voltage that has been subject to threshold voltage compensation) may be supplied to the gate terminal of the first transistor TR1.

The gate terminal of the seventh transistor TR7 (e.g., a third switching transistor) may receive the light emitting diode initialization signal EB. In this case, the light emitting diode initialization signal EB may be provided from the initialization driver 130 through the light emitting diode initialization line EBL. The first terminal of the seventh transistor TR7 may receive the second initialization voltage AVINT. In this case, the second initialization voltage AVINT may be provided from the power supply unit 160 through the second initialization voltage line AVINTL. The second terminal of the seventh transistor TR7 may be connected to the first terminal of the organic light emitting diode OLED. The seventh transistor TR7 may supply the second initialization voltage AVINT to the first terminal of the organic light emitting diode OLED during an activation period of the light emitting diode initialization signal EB. In this case, the seventh transistor TR7 may operate in a linear region. In other words, the seventh transistor TR7 may initialize the first terminal of the organic light emitting diode OLED to the second initialization voltage AVINT during the activation period of the light emitting diode initialization signal EB.

The storage capacitor CST may be connected between the first power supply voltage line ELVDDL and the gate terminal of the first transistor TR1. The storage capacitor CST may include a first terminal and a second terminal. For example, the first terminal of the storage capacitor CST may receive the first power supply voltage ELVDD, and the second terminal of the storage capacitor CST may be connected to the gate terminal of the first transistor TR1. The storage capacitor CST may maintain a voltage level of the gate terminal of the first transistor TR1 during an inactivation period of the data write gate signal GW. The inactivation period of the data write gate signal GW may include the activation period of the emission signal EM, and the driving current ID generated by the first transistor TR1 may be supplied to the organic light emitting diode OLED during the activation period of the emission signal EM. Therefore, the driving current ID generated by the first transistor TR1 may be supplied to the organic light emitting diode OLED based on the voltage level maintained by the storage capacitor CST.

The gate terminal of the eighth transistor TR8 (e.g., a first switching transistor) may receive the light emitting diode initialization signal EB. The first terminal of the eighth transistor TR8 may receive the bias power supply voltage VBIAS. The second terminal of the eighth transistor TR8 may be connected to the first terminal of the first transistor TR1. In some embodiments, the second terminal of the eighth transistor TR8 may be connected to the gate terminal of the first transistor TR1. The eighth transistor TR8 may supply the bias power supply voltage VBIAS to the first terminal of the first transistor TR1 during the activation period of the light emitting diode initialization signal EB. In this case, the first transistor TR1 may be in an on-bias state, and hysteresis of the first transistor TR1 may be reduced. When the hysteresis of the first transistor TR1 is reduced, in a case of driving with a low gray level (or middle and low gray levels) in low-frequency driving of the display device 100, a decrease in a luminance of the organic light emitting diode OLED may be reduced.

The gate terminal of the ninth transistor TR9 (e.g., a second switching transistor) may receive the first power supply voltage ELVDD. The first terminal of the ninth transistor TR9 may be connected to the second terminal of the eighth transistor TR8. The second terminal of the ninth transistor TR9 may be connected to the first node N1.

For example, when an inactivation period of the compensation gate signal GC starts after the activation period of the compensation gate signal GC ends, a voltage of the first node N1 may be increased, and as the voltage of the first node N1 increases, a kickback voltage may be increased, causing a voltage of the gate terminal of the first transistor TR1 to be increased. In this case, as the voltage of the gate terminal of the first transistor TR1 increases, the driving current ID may be decreased, and the luminance of the organic light emitting diode OLED may be decreased (e.g., a flicker phenomenon). Such a flicker phenomenon may be more severe when the pixel PX is driven with a high gray level in the low-frequency driving of the display device 100.

According to the embodiments, when the pixel PX is driven with a high gray level in the low-frequency driving of the display device 100, the driving current ID may be relatively large. When the voltage of the gate terminal of the first transistor TR1 increases to cause the driving current ID to be decreased, a user of the display device 100 may easily recognize the decrease in the luminance. Therefore, the ninth transistor TR9 may be connected between the first node N1 and the second terminal of the eighth transistor TR8, and a relatively low voltage may be applied to the first node N1 through the ninth transistor TR9. In this case, when the inactivation period of the compensation gate signal GC starts, the voltage of the first node N1 may be prevented from increasing, and when the pixel PX is driven with a high gray level in the low-frequency driving of the display device 100, the driving current ID may not be decreased, and the luminance of the organic light emitting diode OLED may also not be decreased. In other words, the kickback voltage may be decreased, so that the flicker phenomenon may be reduced.

However, although the pixel circuit PC according to the present disclosure has been described as including one driving transistor, two dual gate transistors, six switching transistors, and one storage capacitor, the configuration of the present disclosure is not limited thereto. For example, the pixel circuit PC may have a configuration including at least one driving transistor, at least one dual gate transistor, at least one switching transistor, and at least one storage capacitor.

In addition, although the light emitting element included in the pixel PX according to the present disclosure has been described as including the organic light emitting diode OLED, the configuration of the present disclosure is not limited thereto. For example, the light emitting element may include a quantum dot (QD) light emitting element, an inorganic light emitting element, and the like.

Since the display device 100 according to embodiments of the present disclosure includes the eighth transistor TR8, the luminance of the organic light emitting diode OLED may not be decreased when the pixel PX is driven with low and middle gray levels in the low-frequency driving of the display device 100. In addition, since the display device 100 includes the ninth transistor TR9, the luminance of the organic light emitting diode OLED may not be decreased in a case of driving with a high gray level in the low-frequency driving of the display device 100. Accordingly, when the display device 100 is driven at a low frequency, the display device 100 may be driven without the decrease in the luminance of the organic light emitting diode OLED in all gray levels.

Figure 3:
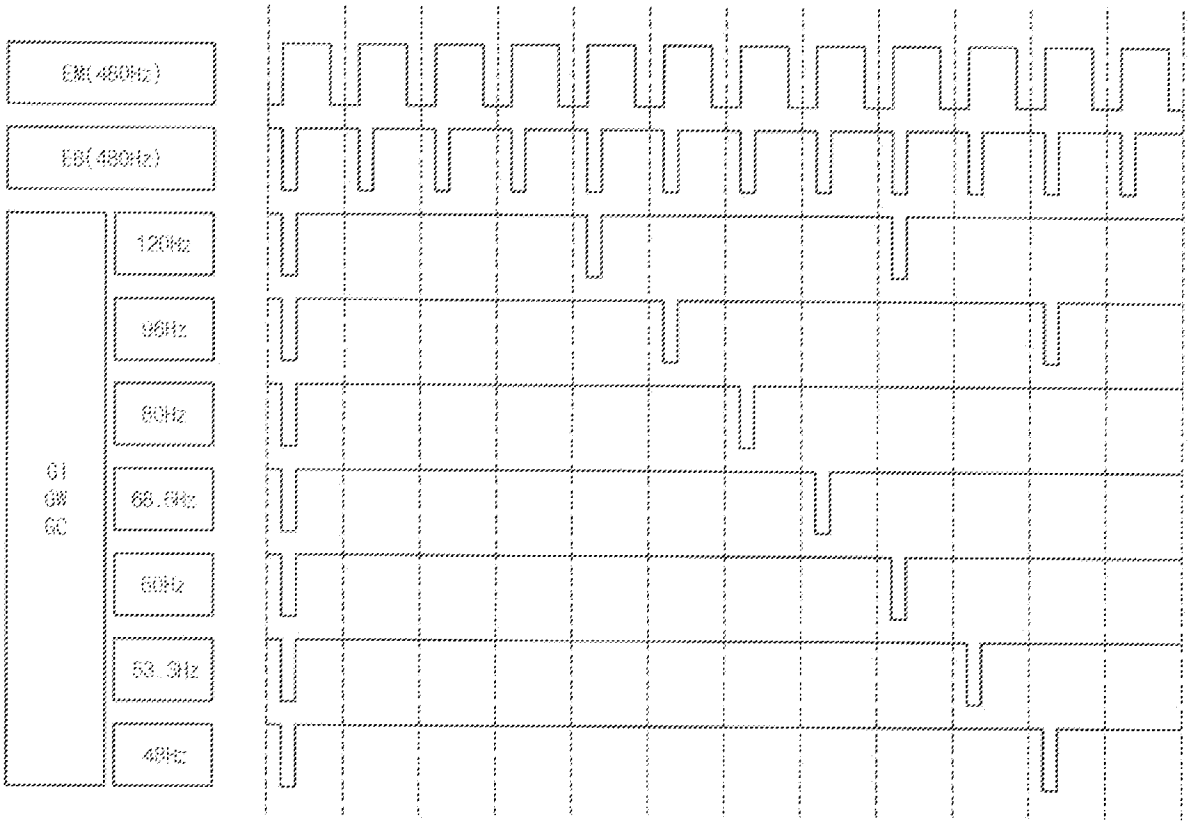
FIG. 3 is a timing diagram for describing signals for driving the display device of FIG. 1.

FIG. 3 is a timing diagram for describing signals for driving the display device of FIG. 1.

Referring to FIG. 3, the display device 100 may be driven at a variable frequency.

For example, the display device 100 may display an image at various driving frequencies (or an image refresh rate or a screen refresh rate) according to driving conditions. The driving frequency may be a frequency at which the data voltage VDATA is substantially written in the first transistor TR1 of the pixel PX. For example, the driving frequency is referred to as a screen scan rate or a screen refresh frequency, and may represent a frequency at which a display screen is refreshed for 1 second. According to the embodiments, the display device 100 may adjust an output frequency of the gate driver 140 and an output frequency of the data driver 120 corresponding to the output frequency of the gate driver 140 according to driving conditions. For example, the display device 100 may display the image at various driving frequencies of 1 Hz to 120 Hz.

The gate driver 140 may be driven at a maximum of 120 Hz. In some embodiments, the gate driver 140 may be driven at a maximum of 240 Hz. The gate driver 140 may periodically provide the data write gate signal GW, the data initialization gate signal GI, or the compensation gate signal GC during some of a plurality of frame periods. As the driving frequency becomes higher, an interval at which the signal is provided may become shorter.

The emission driver 190 may be driven at 480 Hz. The emission driver 190 may provide the emission signal EM every frame period. For example, as described above, in order to rapidly recognize a latency difference between the host processor and the display device 100, the emission driver 190 may be driven at a high frequency. In some embodiments, the emission driver 190 may be driven at 480 Hz to reduce a frame frequency mismatch when the frame frequency of the rendering performed by the host processor is changed, and may be driven at a relatively low frequency when the frame frequency of the rendering performed by the host processor is not changed.

The initialization driver 130 may be driven at 480 Hz. The initialization driver 130 may provide the light emitting diode initialization signal EB every frame periods. For example, the light emitting diode OLED (e.g., the anode terminal) may be initialized to the second initialization voltage AVINT every frame periods. In this case, when the display device 100 is driven at a low frequency, the display device 100 may prevent the decrease in the luminance in a low gray level (or middle and low gray levels). In this case, the low frequency may be a frequency that is greater than 0 Hz and less than 60 Hz. In addition, the high frequency may be greater than or equal to 60 Hz, and less than or equal to 240 Hz. However, the above frequency range is one example, and the high frequency and the low frequency according to the present disclosure are not limited to the above frequency range.

For example, the bias power supply voltage VBIAS may be provided to the source terminal of the first transistor TR1 through the eighth transistor TR8 every frame period. Since the bias power supply voltage VBIAS that is relatively high is provided to the source terminal of the first transistor TR1 every frame periods, the hysteresis of the first transistor TR1 may be reduced. In detail, although the threshold voltage of the first transistor TR1 may vary as a gray level varies, since the bias power supply voltage VBIAS is provided to the source terminal of the first transistor TR1, the variation of the threshold voltage may be reduced. Accordingly, a decrease in a luminance of the pixel PX may be reduced. In other words, when the pixel PX is driven with a low gray level (or middle and low gray levels) in the low-frequency driving of the display device 100, in order to prevent the luminance of the pixel PX from being reduced by the hysteresis of the first transistor TR1, the first transistor TR1 may be set to the on-bias state before the light emitting diode OLED is turned on. Accordingly, even when the pixel PX is driven at a low gray level in the low-frequency driving of the display device 100, the luminance may not be reduced.

In addition, the ninth transistor TR9 connected to the second terminal of the eighth transistor TR8 may supply a relatively low voltage to the first node N1 every frame period. Since the relatively low voltage is provided to the first node N1, the voltage of the first node N1 may be prevented from increasing when the inactivation period of the compensation gate signal GC starts, and the kickback voltage may be decreased so that the flicker phenomenon may be reduced. In other words, when the pixel PX is driven with a high gray level in the low-frequency driving of the display device 100, in order to prevent the luminance of the pixel PX from being reduced by the increase in the kickback voltage, a relatively low voltage may be supplied to the first node N1 before the light emitting diode OLED is turned on. Accordingly, even in a case of driving with a high gray level in the low-frequency driving of the display device 100, the luminance may not be reduced.

Figure 4:
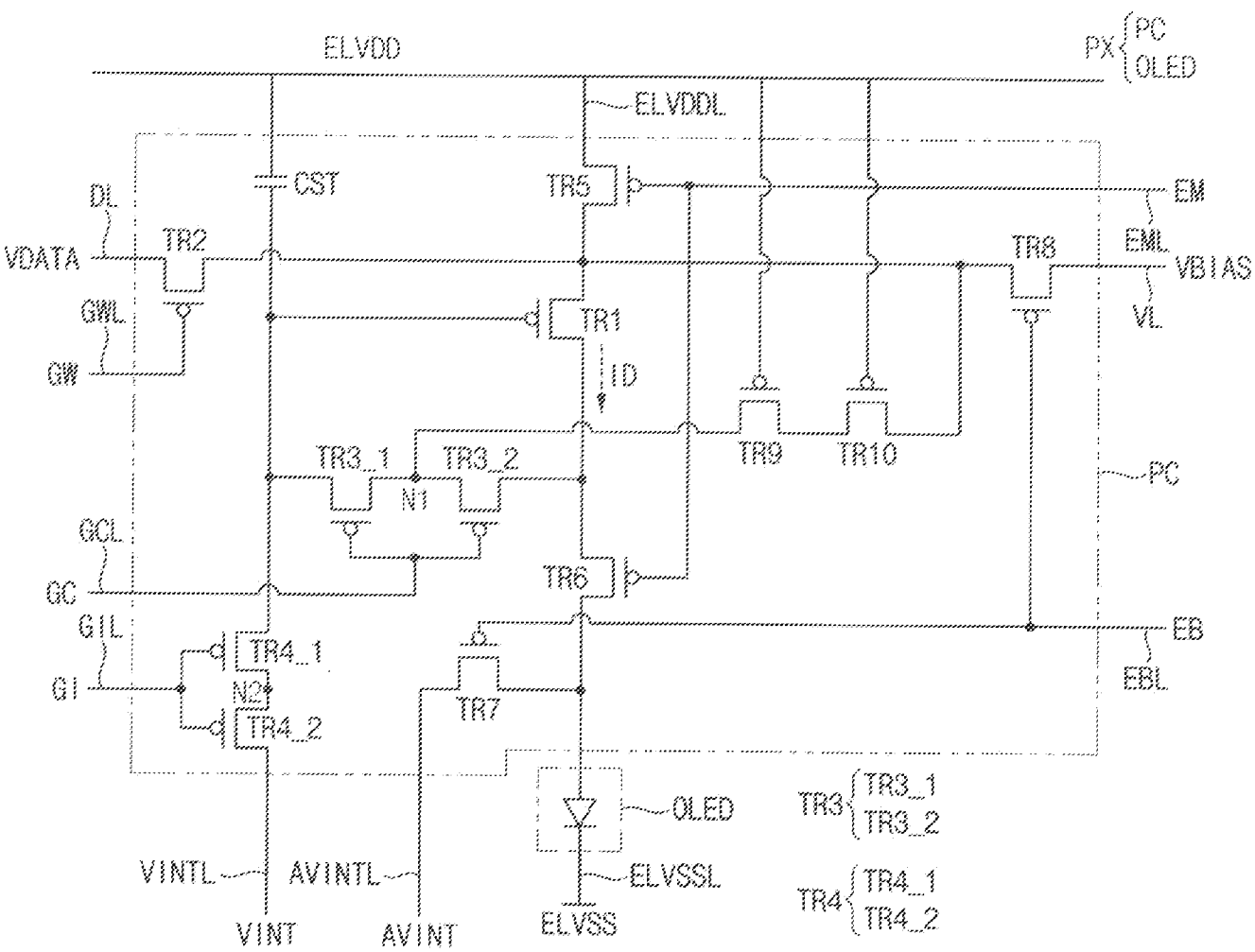
FIG. 4 is a circuit diagram showing a pixel according to embodiments of the present disclosure.

FIG. 4 is a circuit diagram showing a pixel according to an embodiment of the present disclosure. A display device incorporating the pixel illustrated in FIG. 4 may have a configuration that is substantially identical or similar to the configuration of the display device 100 described with reference to FIGS. 1 to 3 except for the configuration of the ninth transistor TR9. In FIG. 4, redundant descriptions of components that are substantially identical or similar to the components described with reference to FIGS. 1 to 3 will be omitted.

Referring to FIG. 4, the a pixel PX of the display device may include a pixel circuit PC and an organic light emitting diode OLED. In this case, the pixel circuit PC may include first to tenth transistors TR1, TR2, TR3, TR4, TR5, TR6, TR7, TR8, TR9, and TR10, a storage capacitor CST, and the like. In addition, the pixel circuit PC or the organic light emitting diode OLED may be connected to the bias power supply voltage line VL, the first power supply voltage line ELVDDL, the second power supply voltage line ELVSSL, the first initialization voltage line VINTL, the second initialization voltage line AVINTL, the light emitting diode initialization line EBL, the data line DL, the data write gate line GWL, the data initialization gate line GIL, the compensation gate line GCL, the emission line EML, and the like. The first transistor TR1 may correspond to a driving transistor, and the second to tenth transistors TR2, TR3, TR4, TR5, TR6, TR7, TR8, TR9, and TR10 may correspond to switching transistors. Each of the first to tenth transistors TR1, TR2, TR3, TR4, TR5, TR6, TR7, TR8, TR9, and TR10 may include a first terminal, a second terminal, and a gate terminal. According to embodiments, the first terminal may be a source terminal, and the second terminal may be a drain terminal. In some embodiments, the first terminal may be a drain terminal, and the second terminal may be a source terminal.

The tenth transistor TR10 (e.g., a seventh switching transistor) may be connected between the ninth transistor TR9 and the eighth transistor TR8. For example, the gate terminal of the tenth transistor TR10 may receive the first power supply voltage ELVDD. The first terminal of the tenth transistor TR10 may be connected to the second terminal of the eighth transistor TR8. The second terminal of the tenth transistor TR10 may be connected to the first terminal of the ninth transistor TR9.

In other words, the ninth transistor TR9 and the tenth transistor TR10 may be connected in series, and the same signal may be applied to the gate terminal of each of the ninth and tenth transistors TR9 and TR10. That is, the gate terminal of each of the ninth and tenth transistors TR9 and TR10 may receive the first power supply voltage ELVDD.

For example, in order to provide a relatively low voltage to the first node N1, the ninth transistor TR9 may be configured as transistors connected in series. The bias power supply voltage VBIAS may have various voltage levels depending on a type of the display device. Therefore, in order to provide a preset voltage to the first node N1, the ninth transistor TR9 and the tenth transistor TR10 may function as transistors for reducing the voltage level of the bias power supply voltage VBIAS provided to the second terminal of the eighth transistor TR8.

However, although the pixel PX according to the present disclosure has been described as including two transistors (i.e., the ninth transistor TR9 and the tenth transistor TR10) connected in series between the eighth transistor TR8 and the first node N1, the configuration of the present disclosure is not limited thereto. For example, the pixel PX may include at least three transistors connected in series between the eighth transistor TR8 and the first node N1.

Since the display device according to the embodiment of FIG. 4 includes the ninth transistor TR9 and the tenth transistor TR10 connected in series between the eighth transistor TR8 and the first node N1, even when the bias power supply voltage VBIAS has a relatively higher voltage level, the preset voltage (e.g., a relatively low voltage) may be provided to the first node N1. Accordingly, when the display device of FIG. 4 is driven at a low frequency, the display device may be driven without the decrease in the luminance of the organic light emitting diode OLED in all gray levels.

Figure 5:
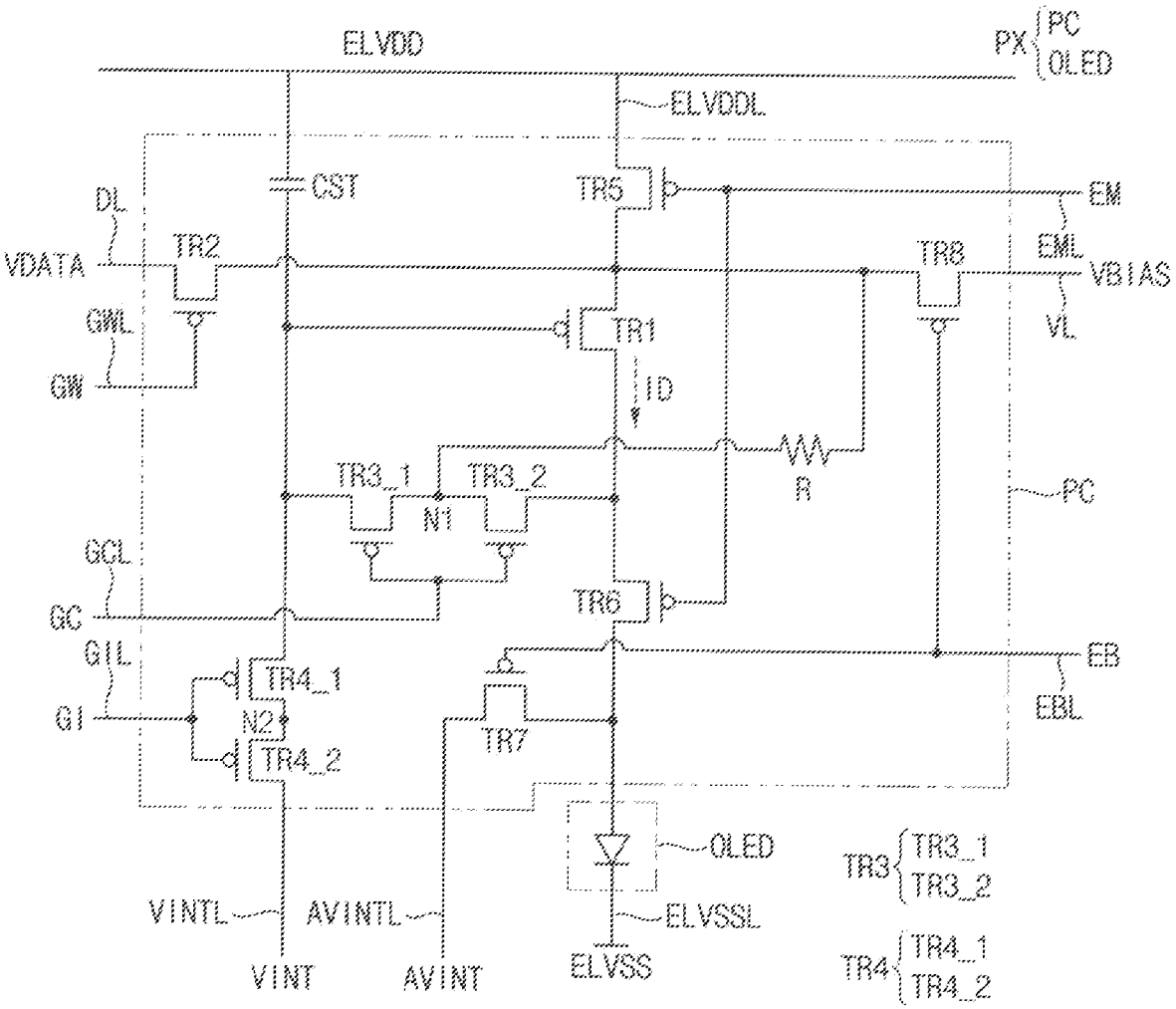
FIG. 5 is a circuit diagram showing a pixel according to embodiments of the present disclosure.

FIG. 5 is a circuit diagram showing a pixel according to embodiments of the present disclosure. A display device illustrated in FIG. 5 may have a configuration that is substantially identical or similar to the configuration of the display device 100 described with reference to FIGS. 1 to 3 except for a resistor R. In FIG. 5, redundant descriptions of components that are substantially identical or similar to the components described with reference to FIGS. 1 to 3 will be omitted.

Referring to FIG. 5, a pixel PX of the display device may include a pixel circuit PC and an organic light emitting diode OLED. In this case, the pixel circuit PC may include first to eighth transistors TR1, TR2, TR3, TR4, TR5, TR6, TR7, and TR8, a resistor R, a storage capacitor CST, and the like. In addition, the pixel circuit PC or the organic light emitting diode OLED may be connected to the bias power supply voltage line VL, the first power supply voltage line ELVDDL, the second power supply voltage line ELVSSL, the first initialization voltage line VINTL, the second initialization voltage line AVINTL, the light emitting diode initialization line EBL, the data line DL, the data write gate line GWL, the data initialization gate line GIL, the compensation gate line GCL, the emission line EML, and the like. The first transistor TR1 may correspond to a driving transistor, and the second to eighth transistors TR2, TR3, TR4, TR5, TR6, TR7, and TR8 may correspond to switching transistors.

The resistor R may be connected between the first node N1 and the second terminal of the eighth transistor TR8.

For example, in order to provide a relatively low voltage to the first node N1, the resistor R may be connected between the first node N1 and the second terminal of the eighth transistor TR8. Therefore, in order to provide a preset voltage to the first node N1, the resistor R may reduce a voltage level of the bias power supply voltage VBIAS provided to the second terminal of the eighth transistor TR8.

In addition, the bias power supply voltage VBIAS may have various voltage levels depending on a type of the display device. Accordingly, the resistor R may have various resistance values according to the voltage level of the bias power supply voltage VBIAS.

However, although the pixel PX according to the present disclosure has been described as including one resistor R between the eighth transistor TR8 and the first node N1, the configuration of the present disclosure is not limited thereto. For example, the pixel PX may include at least two resistors connected in series between the eighth transistor TR8 and the first node N1.

Since the display device according to the embodiment of FIG. 5 includes the eighth transistor TR8 and the resistor R, when the display device is driven at a low frequency, the display device may be driven without the decrease in the luminance of the organic light emitting diode OLED in all gray levels.

In addition, since the display device of FIG. 5 includes the resistor R connected between the eighth transistor TR8 and the first node N1, even when the bias power supply voltage VBIAS has a relatively higher voltage level, the preset voltage (e.g., a relatively low voltage) may be provided to the first node N1.

Figure 6:
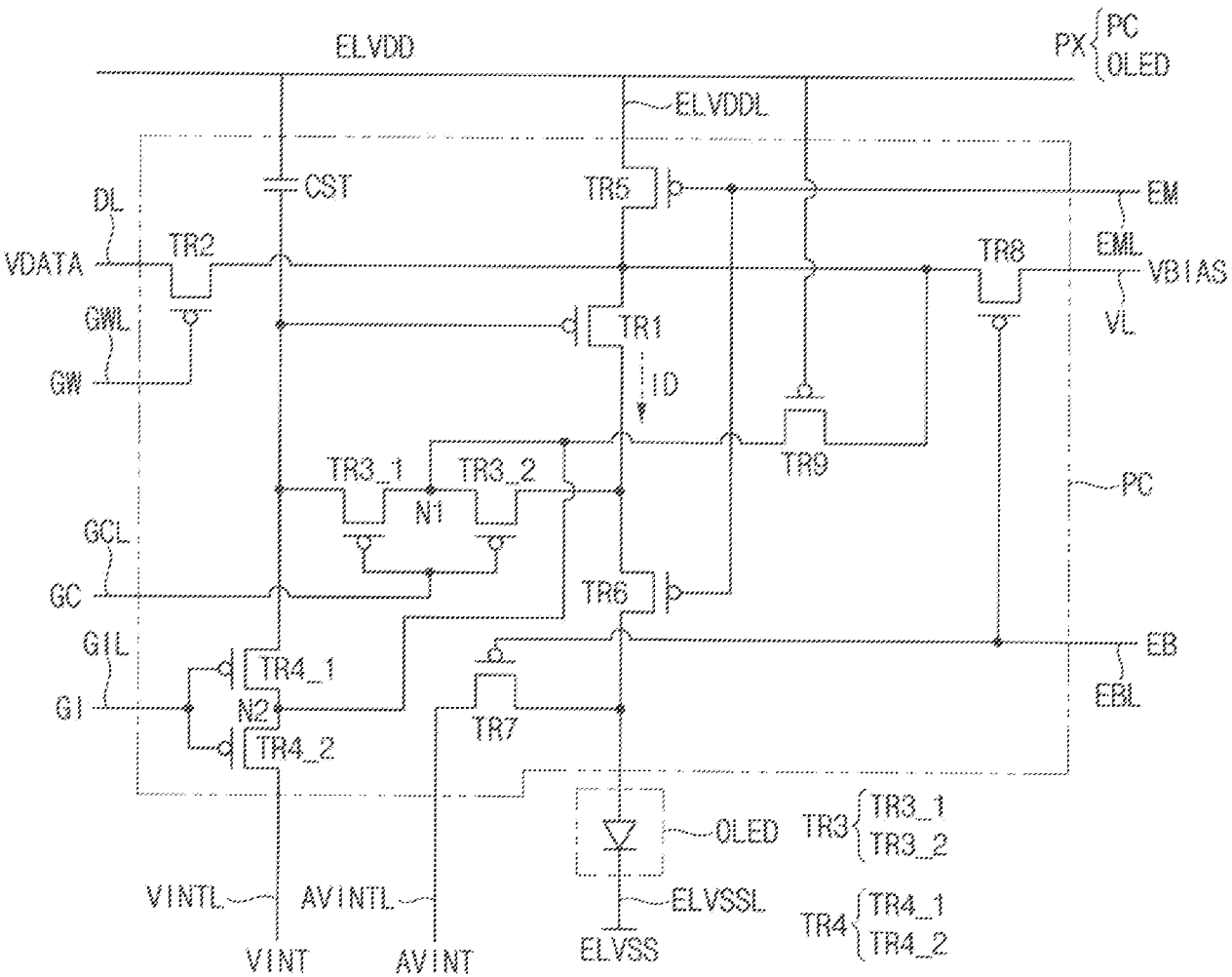
FIG. 6 is a circuit diagram showing a pixel according to embodiments of the present disclosure.

FIG. 6 is a circuit diagram showing a pixel according to an embodiment of the present disclosure. A display device illustrated in FIG. 6 may have a configuration that is substantially identical or similar to the configuration of the display device 100 described with reference to FIGS. 1 to 3 except for the configuration in which the ninth transistor TR9 is connected to the second node N2. In FIG. 6, redundant descriptions of components that are substantially identical or similar to the components described with reference to FIGS. 1 to 3 will be omitted.

Referring to FIG. 6, a pixel PX that is included in the display device may include a pixel circuit PC and an organic light emitting diode OLED. In this case, the pixel circuit PC may include first to ninth transistors TR1, TR2, TR3, TR4, TR5, TR6, TR7, TR8, and TR9, a storage capacitor CST, and the like. In addition, the pixel circuit PC or the organic light emitting diode OLED may be connected to the bias power supply voltage line VL, the first power supply voltage line ELVDDL, the second power supply voltage line ELVSSL, the first initialization voltage line VINTL, the second initialization voltage line AVINTL, the light emitting diode initialization line EBL, the data line DL, the data write gate line GWL, the data initialization gate line GIL, the compensation gate line GCL, the emission line EML, and the like.

The gate terminal of the ninth transistor TR9 may receive the first power supply voltage ELVDD. The first terminal of the ninth transistor TR9 may be connected to the second terminal of the eighth transistor TR8. The second terminal of the ninth transistor TR9 may be simultaneously connected to the first node N1 and the second node N2.

For example, when an inactivation period of the compensation gate signal GC starts after the activation period of the compensation gate signal GC ends, a voltage of the first node N1 may be increased, and as the voltage of the first node N1 increases, a kickback voltage may be increased, causing a voltage of the gate terminal of the first transistor TR1 to be increased. In addition, when an inactivation period of the data initialization gate signal GI starts after the activation period of the data initialization gate signal GI ends, a voltage of the second node N2 may be increased, and as the voltage of the second node N2 increases, the kickback voltage may be increased, causing the voltage of the gate terminal of the first transistor TR1 to be increased. In this case, as the voltage of the gate terminal of the first transistor TR1 increases, the driving current ID may be decreased, and the luminance of the organic light emitting diode OLED may be decreased (e.g., a flicker phenomenon). Such a flicker phenomenon may be more severe when the pixel PX is driven with a high gray level in the low-frequency driving of the display device.

According to embodiments, when the pixel PX is driven with a high gray level in the low-frequency driving of the display device, the driving current ID may be relatively large. When the voltage of the gate terminal of the first transistor TR1 increases to cause the driving current ID to be decreased, a user of the display device may easily recognize the decrease in luminance. Therefore, the ninth transistor TR9 may be connected between the first and second nodes N1 and N2 and the second terminal of the eighth transistor TR8, and a relatively low voltage may be applied to the first and second nodes N1 and N2 through the ninth transistor TR9. In this case, when the inactivation period of each of the compensation gate signal GC and the data initialization gate signal GI starts, the voltage of each of the first and second nodes N1 and N2 may be prevented from increasing, and when the pixel PX is driven with a high gray level in the low-frequency driving of the display device, the driving current ID may not be decreased, and the luminance of the organic light emitting diode OLED may also not be decreased. In other words, the kickback voltage may be decreased at the first and second nodes N1 and N2, so that the flicker phenomenon may be further reduced.

Since the display device according to the embodiment of FIG. 6 includes the eighth transistor TR8 and the ninth transistor TR9, the hysteresis of the first transistor TR1 may be reduced, and the voltage of each of the first and second nodes N1 and N2 may be prevented from increasing so that the flicker phenomenon may be further reduced. Accordingly, when the display device of FIG. 6 is driven at a low frequency, the display device may be driven without the decrease in the luminance of the organic light emitting diode OLED in all gray levels.

Figure 7:
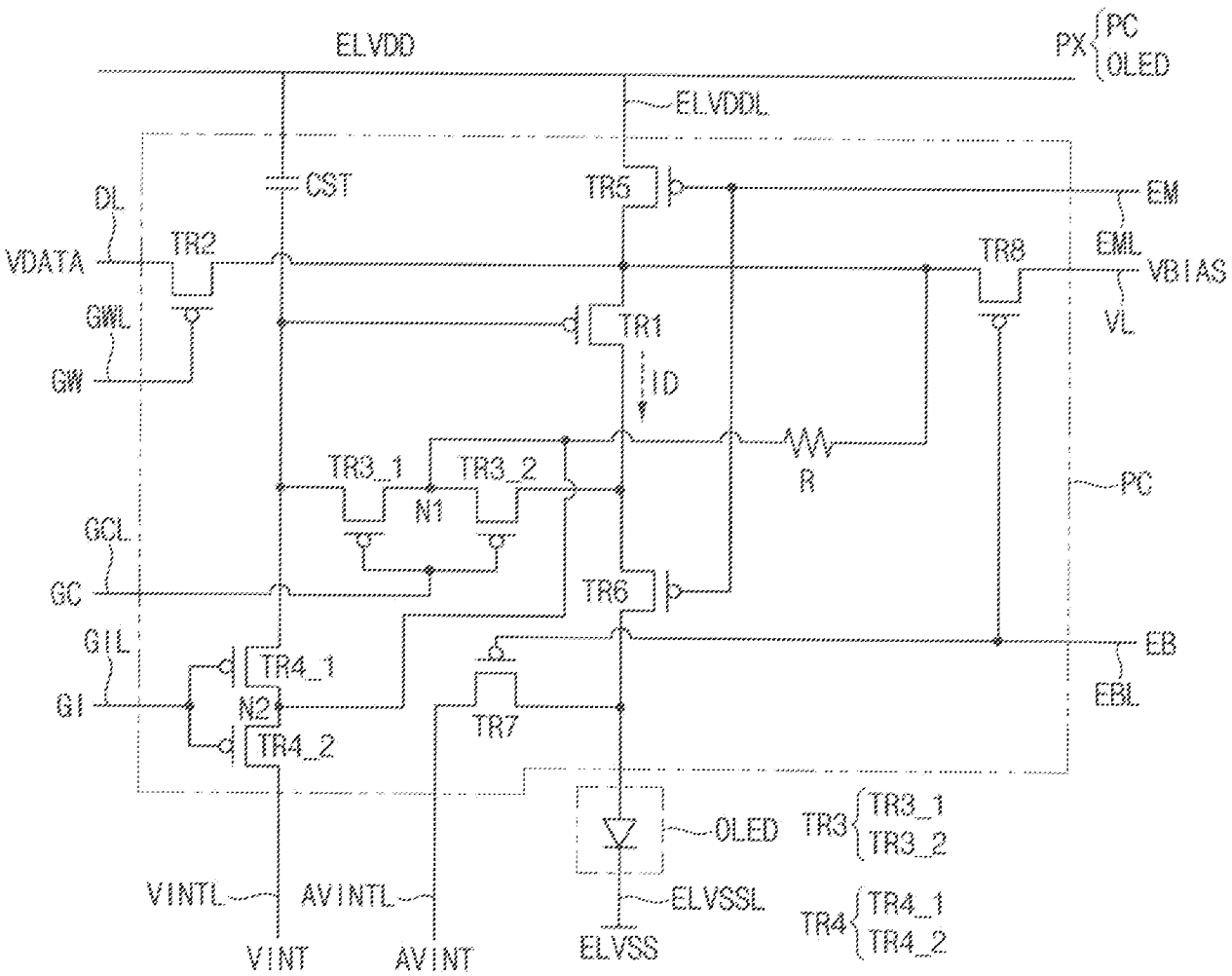
FIG. 7 is a circuit diagram showing a pixel according to embodiments of the present disclosure.

FIG. 7 is a circuit diagram showing a pixel according to embodiments of the present disclosure. A display device illustrated in FIG. 7 may have a configuration that is substantially identical or similar to the configuration of the display device described with reference to FIG. 6 except for a resistor R replacing the ninth transistor TR9. In FIG. 7, redundant descriptions of components that are substantially identical or similar to the components described with reference to FIG. 6 will be omitted.

Referring to FIG. 7, a pixel PX of the display device that is shown may include a pixel circuit PC and an organic light emitting diode OLED. In this case, the pixel circuit PC may include first to eighth transistors TR1, TR2, TR3, TR4, TR5, TR6, TR7, and TR8, a resistor R, a storage capacitor CST, and the like.

The resistor R may be connected between the first and second nodes N1 and N2 and the second terminal of the eighth transistor TR8.

For example, in order to provide a relatively low voltage to each of the first and second nodes N1 and N2, the resistor R may be connected between the first and second nodes N1 and N2 and the second terminal of the eighth transistor TR8. Therefore, in order to provide a preset voltage to each of the first and second nodes N1 and N2, the resistor R may reduce a voltage level of the bias power supply voltage VBIAS provided to the second terminal of the eighth transistor TR8.

Figure 8:
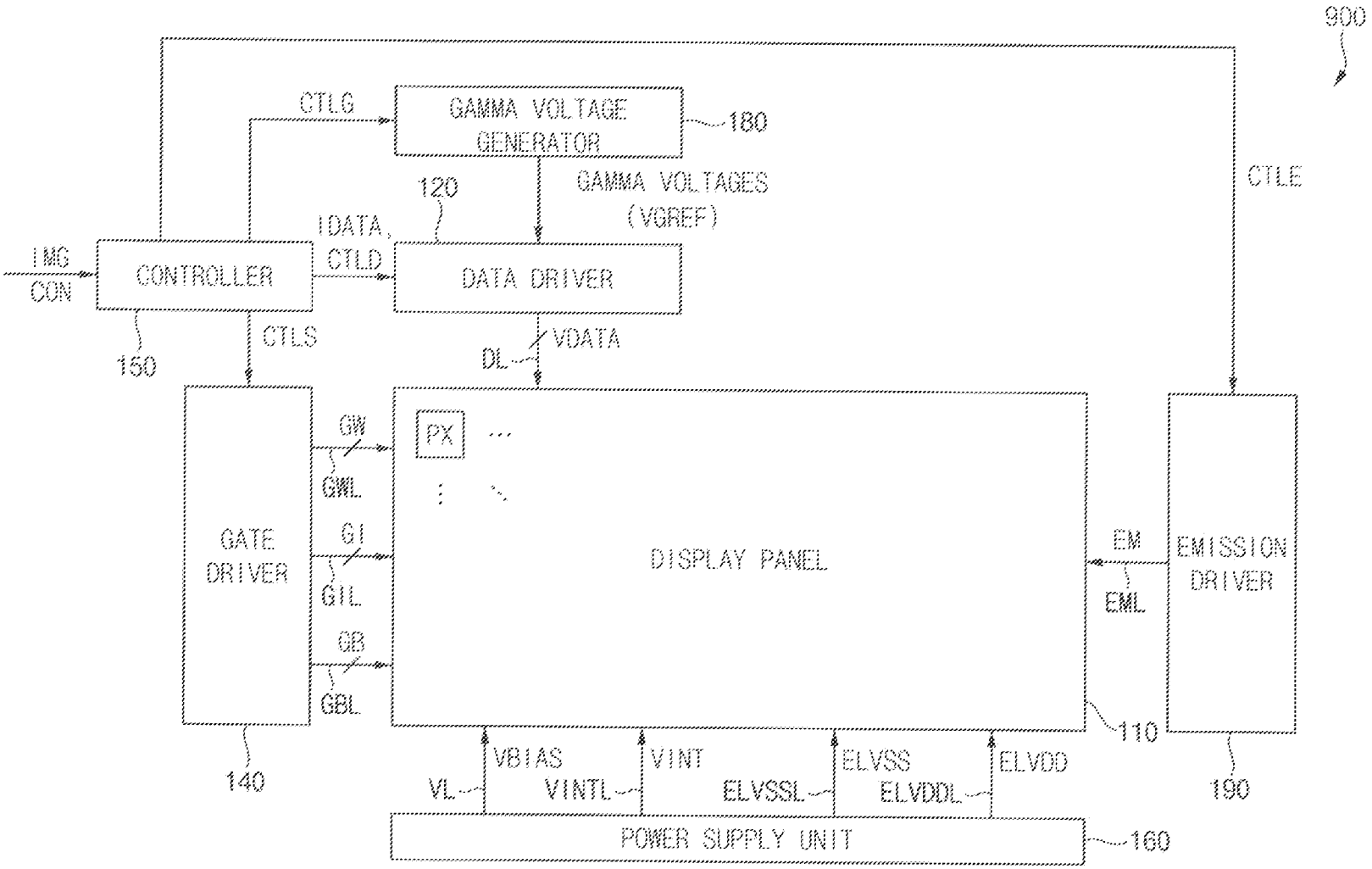
FIG. 8 is a block diagram showing a display device according to embodiments of the present disclosure.

FIG. 8 is a block diagram showing a display device according to embodiments of the present disclosure.

Referring to FIG. 8, a display device 900 may include a display panel 110 including a plurality of pixels PX, a controller 150, a data driver 120, a gate driver 140, an emission driver 190, a power supply unit 160, a gamma reference voltage generator 180, and the like.

The display panel 110 may include a plurality of data lines DL, a plurality of data write gate lines GWL, a plurality of data initialization gate lines GIL, a plurality of emission lines EML, a plurality of light emitting diode initialization lines GBL, a plurality of first power supply voltage lines ELVDDL, a plurality of second power supply voltage lines ELVSSL, a plurality of initialization voltage lines VINTL, a plurality of bias power supply voltage lines VL, and a plurality of pixels PX connected to the lines.

According to the embodiments, the display panel 110 may be a display panel of an organic light emitting display device (OLED).

The controller 150 may receive image data IMG and an input control signal CON from an external host processor. The image data IMG may be RGB image data including red image data, green image data, and blue image data. In addition, the image data IMG may include information on a driving frequency. The control signal CON may include a vertical synchronization signal, a horizontal synchronization signal, an input data enable signal, a master clock signal, and the like, but the embodiments are not limited thereto.

The controller 150 may convert the image data IMG into input image data DATA by applying an algorithm for correcting image quality to the image data IMG supplied from the external host processor. In some embodiments, when the controller 150 does not include an algorithm for improving image quality, the image data IMG may be output as the input image data IDATA. The controller 150 may supply the input image data IDATA to the data driver 120.

The controller 150 may generate a data control signal CTLD for controlling an operation of the data driver 120, a gate control signal CTLS for controlling an operation of the gate driver 140, an emission control signal CTLE for controlling an operation of the emission driver 190, and a gamma control signal CTLG for controlling an operation of the gamma reference voltage generator 180 based on the input control signal CON. For example, the gate control signal CTLS may include a vertical start signal, gate clock signals, and the like, and the data control signal CTLD may include a horizontal start signal, a data clock signal, and the like.

The gate driver 140 may generate data write gate signals GW, data initialization gate signals GI, and light emitting diode initialization signals GB based on the gate control signal CTLS received from the controller 150. The gate driver 140 may output the data write gate signals GW, the data initialization gate signals GI, and the light emitting diode initialization signals GB to the pixels PX connected to the data write gate lines GWL, the data initialization gate lines GIL, and the light emitting diode initialization lines GBL.

The emission driver 190 may generate emission signals EM based on the emission control signal CTLE received from the controller 150. The emission driver 190 may output the emission signals EM to the pixels PX connected to the emission lines EML.

The power supply unit 160 may generate a bias power supply voltage VBIAS, an initialization voltage VINT, a first power supply voltage ELVDD, and a second power supply voltage ELVSS, and may provide the bias power supply voltage VBIAS, the initialization voltage VINT, the first power supply voltage ELVDD, and the second power supply voltage ELVSS to the pixels PX through the bias power supply voltage line VL, the initialization voltage line VINTL, the first power supply voltage line ELVDDL, and the second power supply voltage line ELVSSL.

The display device 900 may be a display device configured to display an image at a fixed frame frequency (or a constant refresh rate) such as about 60 Hz, about 120 Hz, or about 240 Hz.

The gamma reference voltage generator 180 may generate a gamma reference voltage VGREF based on the gamma control signal CTLG received from the controller 150. The gamma reference voltage generator 180 may provide the gamma reference voltage VGREF to the data driver 120. The gamma reference voltage VGREF provided to the data driver 120 may have a value corresponding to each input image data IDATA. In some embodiments, the gamma reference voltage generator 180 may be formed integrally with the data driver 120 or the controller 150.

The data driver 120 may receive the data control signal CTLD and the input image data IDATA from the controller 150, and may receive the gamma reference voltage VGREF from the gamma reference voltage generator 180. The data driver 120 may convert digital input image data IDATA into an analog data voltage by using the gamma reference voltage VGREF. In this case, the analog data voltage obtained by the conversion will be defined as a data voltage VDATA. The data driver 120 may output data voltages VDATA to the pixels PX connected to the data lines DL based on the data control signal CTLD. According to other embodiments, the data driver 120 and the controller 150 may be implemented as a single integrated circuit, and such an integrated circuit may be referred to as a timing controller-embedded data driver (TED).

Figure 9:
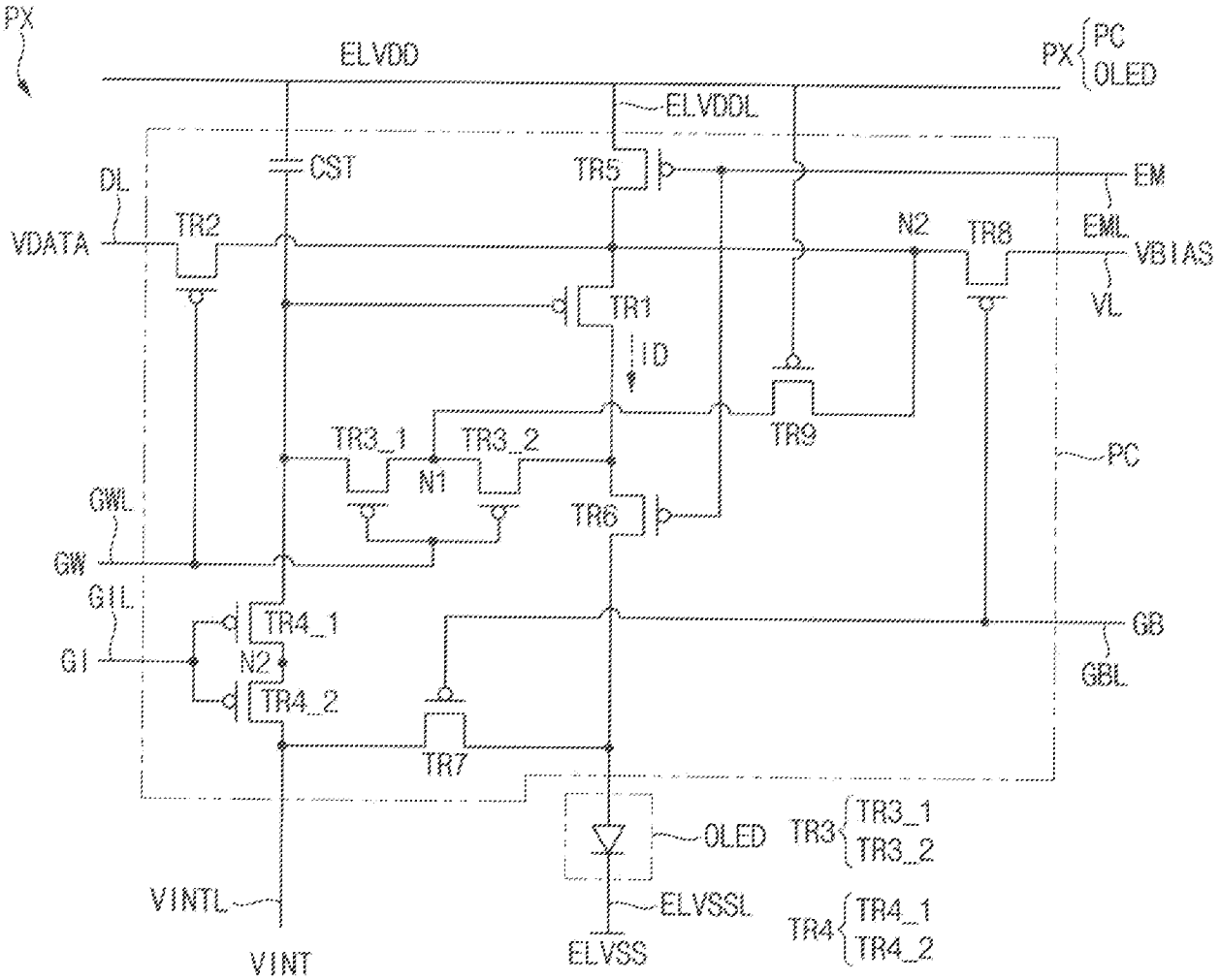
FIG. 9 is a circuit diagram showing a pixel included in FIG. 8.

FIG. 9 is a circuit diagram showing a pixel included in FIG. 8.

Referring to FIG. 9, a pixel PX of the display device that is shown may include a pixel circuit PC and an organic light emitting diode OLED. The display device of FIG. 9 may be the display device 900 of FIG. 8. In this case, the pixel circuit PC may include first to ninth transistors TR1, TR2, TR3, TR4, TR5, TR6, TR7, TR8, and TR9, a storage capacitor CST, and the like. In addition, the pixel circuit PC or the organic light emitting diode OLED may be connected to the bias power supply voltage line VL, the first power supply voltage line ELVDDL, the second power supply voltage line ELVSSL, the initialization voltage line VINTL, the light emitting diode initialization line GBL, the data line DL, the data write gate line GWL, the data initialization gate line GIL, the emission line EML, and the like. The first transistor TR1 may correspond to a driving transistor, and the second to ninth transistors TR2, TR3, TR4, TR5, TR6, TR7, TR8, and TR9 may correspond to switching transistors. Each of the first to ninth transistors TR1, TR2, TR3, TR4, TR5, TR6, TR7, TR8, and TR9 may include a first terminal, a second terminal, and a gate terminal. According to embodiments, the first terminal may be a source terminal, and the second terminal may be a drain terminal. In some embodiments, the first terminal may be a drain terminal, and the second terminal may be a source terminal.

The organic light emitting diode OLED may output a light based on a driving current ID. The organic light emitting diode OLED may include a first terminal and a second terminal. According to the embodiments, the second terminal of the organic light emitting diode OLED may receive the second power supply voltage ELVSS, and the first terminal of the organic light emitting diode OLED may receive the first power supply voltage ELVDD. In this case, the first power supply voltage ELVDD and the second power supply voltage ELVSS may be provided from the power supply unit 160 through the first power supply voltage line ELVDDL and the second power supply voltage line ELVSSL, respectively. For example, the first terminal of the organic light emitting diode OLED may be an anode terminal, and the second terminal of the organic light emitting diode OLED may be a cathode terminal. In some embodiments, the first terminal of the organic light emitting diode OLED may be a cathode terminal, and the second terminal of the organic light emitting diode OLED may be an anode terminal.

The first power supply voltage ELVDD and the bias power supply voltage VBIAS may be applied to the first terminal of the first transistor TR1. The second terminal of the first transistor TR1 may be connected to the first terminal of the organic light emitting diode OLED. The initialization voltage VINT may be applied to the gate terminal of the first transistor TR1. In this case, the bias power supply voltage VBIAS and the initialization voltage VINT may be provided from the power supply unit 160 through the bias power supply voltage line VL and the initialization voltage line VINTL, respectively. The first transistor TR1 may generate the driving current ID.

The gate terminal of the second transistor TR2 may receive the data write gate signal GW. In this case, the data write gate signal GW may be provided from the gate driver 140 through the data write gate line GWL. The first terminal of the second transistor TR2 may receive the data voltage VDATA. In this case, the data voltage VDATA may be provided from the data driver 120 through the data line DL. The second terminal of the second transistor TR2 may be connected to the first terminal of the first transistor TR1. The second transistor TR2 may supply the data voltage VDATA to the first terminal of the first transistor TR1 during an activation period of the data write gate signal GW.

The gate terminal of the third transistor TR3 may receive the data write gate signal GW. The first terminal of the third transistor TR3 may be connected to the gate terminal of the first transistor TR1. The second terminal of the third transistor TR3 may be connected to the second terminal of the first transistor TR1. In other words, the third transistor TR3 may be connected between the gate terminal of the first transistor TR1 and the second terminal of the first transistor TR1.

The third transistor TR3 may connect the gate terminal of the first transistor TR1 to the second terminal of the first transistor TR1 during an activation period of the data write gate signal GW. That is, the third transistor TR3 may diode-connect the first transistor TR1 during the activation period of the data write gate signal GW. Since the first transistor TR1 is diode-connected, a voltage difference corresponding to a threshold voltage of the first transistor TR1 may occur between the first terminal of the first transistor TR1 and the gate terminal of the first transistor TR1. As a result, a voltage obtained by summing up the data voltage VDATA supplied to the first terminal of the first transistor TR1 and the voltage difference (i.e., the threshold voltage) may be supplied to the gate terminal of the first transistor TR1 during the activation period of the data write gate signal GW. In other words, the data voltage VDATA may be compensated for by the threshold voltage of the first transistor TR1, and the compensated data voltage VDATA may be supplied to the gate terminal of the first transistor TR1.

According to the embodiments, the third transistor TR3 may be defined as a first dual gate transistor. The first dual gate transistor may include a first sub-transistor TR3_1 and a second sub-transistor TR3_2. The first sub-transistor TR3_1 and the second sub-transistor TR3_2 may be connected in series, and a first node N1 may connect the first sub-transistor TR3_1 and the second sub-transistor TR3_2 to each other. In other words, the third transistor TR3 may operate as a dual gate transistor, and the same signal may be applied to a gate terminal of each of the first and second sub-transistors TR3_1 and TR3_2. In other words, the gate electrode of each of the first and second sub-transistors TR3_1 and TR3_2 may receive the data write gate signal GW. In addition, a second terminal of the first sub-transistor TR3_1 and a first terminal of the second sub-transistor TR3_2 may be connected to each other.

The gate terminal of the fourth transistor TR4 may receive the data initialization gate signal GI. In this case, the data initialization gate signal GI may be provided from the gate driver 140 through the data initialization gate line GIL. The first terminal of the fourth transistor TR4 may receive the initialization voltage VINT. The second terminal of the fourth transistor TR4 may be connected to the gate terminal of the first transistor TR1. In other words, the fourth transistor TR4 may be connected between the first sub-transistor TR3_1 and the initialization voltage line VINTL.

The fourth transistor TR4 may supply the initialization voltage VINT to the gate terminal of the first transistor TR1 during an activation period of the data initialization gate signal GI. In other words, the fourth transistor TR4 may initialize the gate terminal of the first transistor TR1 to the initialization voltage VINT during the activation period of the data initialization gate signal GI. According to the embodiments, the initialization voltage VINT may have a voltage level that is sufficiently lower than a voltage level of the data voltage VDATA maintained by the storage capacitor CST in a previous frame, and the initialization voltage VINT may be supplied to the gate terminal of the first transistor TR1.

According to the embodiments, the fourth transistor TR4 may be defined as a second dual gate transistor. The second dual gate transistor may include a third sub-transistor TR4_1 and a fourth sub-transistor TR4_2. The third sub-transistor TR4_1 and the fourth sub-transistor TR4_2 may be connected in series, and a second node N2 may connect the third sub-transistor TR4_1 and the fourth sub-transistor TR4_2 to each other. In other words, the fourth transistor TR4 may operate as a dual gate transistor, and the same signal may be applied to a gate terminal of each of the third and fourth sub-transistors TR4_1 and TR4_2. In other words, the gate electrode of each of the third and fourth sub-transistors TR4_1 and TR4_2 may receive the data initialization gate signal GI. In addition, a second terminal of the third sub-transistor TR4_1 and a first terminal of the fourth sub-transistor TR4_2 may be connected to each other.

The gate terminal of the fifth transistor TR5 may receive the emission signal EM. In this case, the emission signal EM may be provided from the emission driver 190 through the emission line EML. The first terminal of the fifth transistor TR5 may receive the first power supply voltage ELVDD. The second terminal of the fifth transistor TR5 may be connected to the first terminal of the first transistor TR1. The fifth transistor TR5 may supply the first power supply voltage ELVDD to the first terminal of the first transistor TR1 during an activation period of the emission signal EM. On the contrary, the fifth transistor TR5 may cut off the supply of the first power supply voltage ELVDD during an inactivation period of the emission signal EM. Since the fifth transistor TR5 supplies the first power supply voltage ELVDD to the first terminal of the first transistor TR1 during the activation period of the emission signal EM, the first transistor TR1 may generate the driving current ID. In addition, since the fifth transistor TR5 cuts off the supply of the first power supply voltage ELVDD during the inactivation period of the emission signal EM, the data voltage VDATA supplied to the first terminal of the first transistor TR1 may be supplied to the gate terminal of the first transistor TR1.

The gate terminal of the sixth transistor TR6 may receive the emission signal EM. The first terminal of the sixth transistor TR6 may be connected to the second terminal of the first transistor TR1. The second terminal of the sixth transistor TR6 may be connected to the first terminal of the organic light emitting diode OLED. The sixth transistor TR6 may supply the driving current ID generated by the first transistor TR1 to the organic light emitting diode OLED during the activation period of the emission signal EM. In other words, since the sixth transistor TR6 supplies the driving current ID generated by the first transistor TR1 to the organic light emitting diode OLED during the activation period of the emission signal EM, the organic light emitting diode OLED may output light. In addition, since the sixth transistor TR6 electrically separates the first transistor TR1 and the organic light emitting diode OLED from each other during the inactivation period of the emission signal EM, the compensated data voltage VDATA supplied to the second terminal of the first transistor TR1 may be supplied to the gate terminal of the first transistor TR1.

The gate terminal of the seventh transistor TR7 may receive the light emitting diode initialization signal GB. In this case, the light emitting diode initialization signal GB may be provided from the gate driver 140 through the light emitting diode initialization line GBL. The first terminal of the seventh transistor TR7 may receive the initialization voltage VINT. The second terminal of the seventh transistor TR7 may be connected to the first terminal of the organic light emitting diode OLED. The seventh transistor TR7 may supply the initialization voltage VINT to the first terminal of the organic light emitting diode OLED during an activation period of the light emitting diode initialization signal GB. In other words, the seventh transistor TR7 may initialize the first terminal of the organic light emitting diode OLED to the initialization voltage VINT during the activation period of the light emitting diode initialization signal GB.

The storage capacitor CST may be connected between the first power supply voltage line ELVDDL and the gate terminal of the first transistor TR1. The storage capacitor CST may include a first terminal and a second terminal. For example, the first terminal of the storage capacitor CST may receive the first power supply voltage ELVDD, and the second terminal of the storage capacitor CST may be connected to the gate terminal of the first transistor TR1. The storage capacitor CST may maintain a voltage level of the gate terminal of the first transistor TR1 during an inactivation period of the data write gate signal GW. The inactivation period of the data write gate signal GW may include the activation period of the emission signal EM, and the driving current ID generated by the first transistor TR1 may be supplied to the organic light emitting diode OLED during the activation period of the emission signal EM. Therefore, the driving current ID generated by the first transistor TR1 may be supplied to the organic light emitting diode OLED based on the voltage level maintained by the storage capacitor CST.

The gate terminal of the eighth transistor TR8 may receive the light emitting diode initialization signal GB. The first terminal of the eighth transistor TR8 may receive the bias power supply voltage VBIAS. The second terminal of the eighth transistor TR8 may be connected to the first terminal of the first transistor TR1. The eighth transistor TR8 may supply the bias power supply voltage VBIAS to the first terminal of the first transistor TR1 during the activation period of the light emitting diode initialization signal GB. In this case, the first transistor TR1 may be in an on-bias state, and hysteresis of the first transistor TR1 may be reduced. When the hysteresis of the first transistor TR1 is reduced, in a case of driving with a low gray level (or middle and low gray levels) in low-frequency driving of the display device of FIG. 9, a decrease in a luminance of the organic light emitting diode OLED may be reduced.

The gate terminal of the ninth transistor TR9 may receive the first power supply voltage ELVDD. The first terminal of the ninth transistor TR9 may be connected to the second terminal of the eighth transistor TR8. The second terminal of the ninth transistor TR9 may be connected to the first node N1.

For example, the data write gate line GWL, the data initialization gate line GIL, the light emitting diode initialization line GBL, the data line DL, and the like may be disposed at a periphery of the first node N1, and a voltage of the first node N1 may fluctuate due to voltage variations of the data write gate signal GW, the data initialization gate signal GI, the light emitting diode initialization signal GB, and the data voltage VDATA. According to the embodiments, since the first node N1 and the ninth transistor TR9 are connected to each other, the voltage fluctuation at the first node N1 may be reduced.

In addition, when the pixel PX is driven with a high gray level in the low-frequency driving of the display device of FIG. 9, the driving current ID may be relatively large. When the voltage of the gate terminal of the first transistor TR1 increases to cause the driving current ID to be decreased, a user of the display device may easily recognize the decrease in the luminance. Therefore, the ninth transistor TR9 may be connected between the first node N1 and the second terminal of the eighth transistor TR8, and a relatively low voltage may be applied to the first node N1 through the ninth transistor TR9. In this case, when the inactivation period of the data write gate signal GW starts, the voltage of the first node N1 may be prevented from increasing, and when the pixel PX is driven with a high gray level in the low-frequency driving of the display device, the driving current ID may not be decreased, and the luminance of the organic light emitting diode OLED may also not be decreased. In other words, the kickback voltage may be decreased, so that the flicker phenomenon may be reduced.

Figure 10:
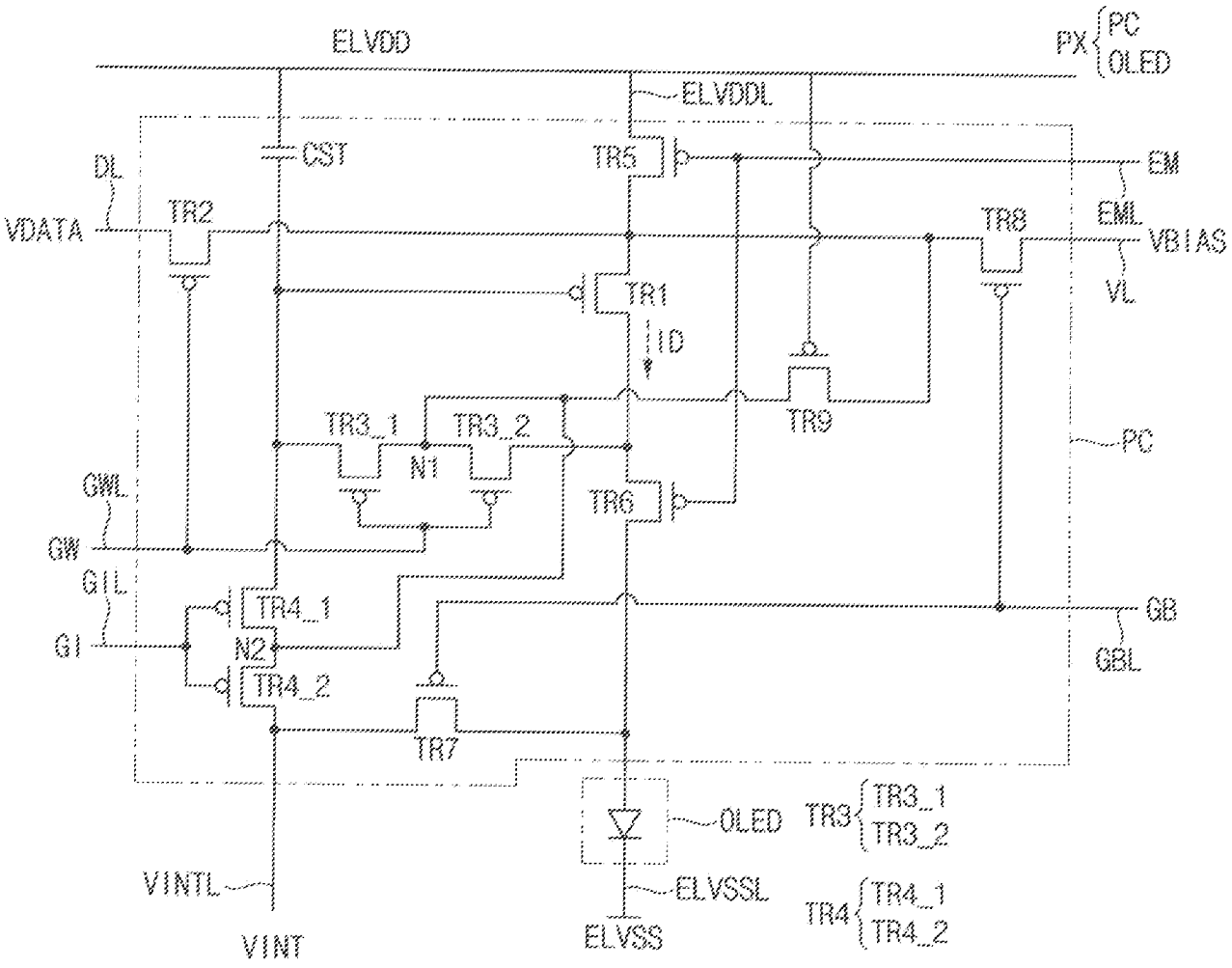
FIG. 10 is a circuit diagram showing a pixel according to embodiments of the present disclosure.

FIG. 10 is a circuit diagram showing a pixel according to embodiments of the present disclosure. A display device illustrated in FIG. 10 may have a configuration that is substantially identical or similar to the configuration of the display device that is described with reference to FIGS. 8 and 9 except for the configuration in which the ninth transistor TR9 is connected to the second node N2. In FIG. 10, redundant descriptions of components that are substantially identical or similar to the components described with reference to FIGS. 8 and 9 will be omitted.

Referring to FIG. 10, a pixel PX of the display device may include a pixel circuit PC and an organic light emitting diode OLED. In this case, the pixel circuit PC may include first to ninth transistors TR1, TR2, TR3, TR4, TR5, TR6, TR7, TR8, and TR9, a storage capacitor CST, and the like. In addition, the pixel circuit PC or the organic light emitting diode OLED may be connected to the bias power supply voltage line VL, the first power supply voltage line ELVDDL, the second power supply voltage line ELVSSL, the initialization voltage line VINTL, the light emitting diode initialization line GBL, the data line DL, the data write gate line GWL, the data initialization gate line GIL, the emission line EML, and the like. The first transistor TR1 may correspond to a driving transistor, and the second to ninth transistors TR2, TR3, TR4, TR5, TR6, TR7, TR8, and TR9 may correspond to switching transistors.

The gate terminal of the ninth transistor TR9 may receive the first power supply voltage ELVDD. The first terminal of the ninth transistor TR9 may be connected to the second terminal of the eighth transistor TR8. The second terminal of the ninth transistor TR9 may be simultaneously connected to the first node N1 and the second node N2.

For example, the data write gate line GWL, the data initialization gate line GIL, the light emitting diode initialization line GBL, the data line DL, and the like may be disposed at peripheries of the first and second nodes N1 and N2, and voltages of the first and second nodes N1 and N2 may fluctuate due to voltage variations of the data write gate signal GW, the data initialization gate signal GI, the light emitting diode initialization signal GB, and the data voltage VDATA. According to embodiments, since the first and second nodes N1 and N2 and the ninth transistor TR9 are connected to each other, the voltage fluctuations of the first and second nodes N1 and N2 may be reduced.

In addition, when the pixel PX is driven with a high gray level in the low-frequency driving of the display device shown in FIG. 10, the driving current ID may be relatively large. When the voltage of the gate terminal of the first transistor TR1 increases to cause the driving current ID to be decreased, a user of the display device in FIG. 10 may easily recognize the decrease in the luminance. Therefore, the ninth transistor TR9 may be connected between the first and second nodes N1 and N2 and the second terminal of the eighth transistor TR8, and a relatively low voltage may be applied to each of the first and second nodes N1 and N2 through the ninth transistor TR9. In this case, when the inactivation period of each of the data write gate signal GW and the data initialization gate signal GI starts, the voltage of each of the first and second nodes N1 and N2 may be prevented from increasing, and when the pixel PX is driven with a high gray level in the low-frequency driving of the display device of FIG. 10, the driving current ID may not be decreased, and the luminance of the organic light emitting diode OLED may also not be decreased. In other words, the kickback voltage may be decreased, so that the flicker phenomenon may be further reduced.

Figure 11:
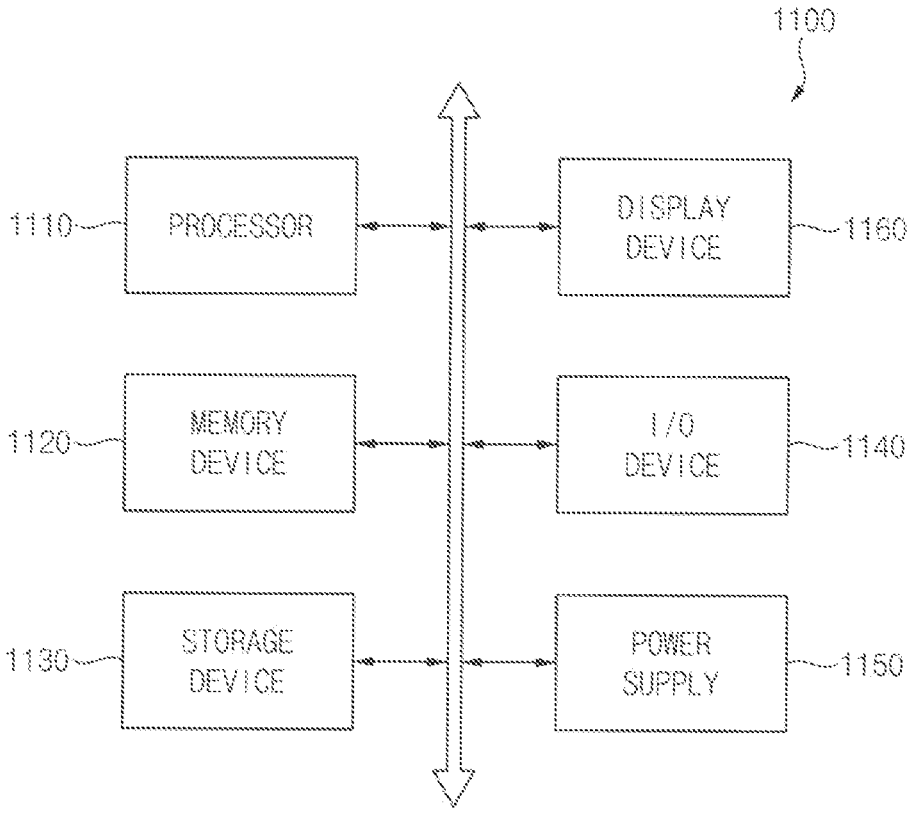
FIG. 11 is a block diagram illustrating an electronic device including a display device according to the present disclosure.

FIG. 11 is a block diagram illustrating an electronic device including a display device according to the present disclosure.

Referring to FIG. 11, an electronic device 1100 may include a processor 1110, a memory device 1120, a storage device 1130, an input/output (I/O) device 1140, a power supply 1150, and a display device 1160. The electronic device 1100 may further include a plurality of ports for communicating with a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The OLED display device 1160 may be coupled to other components through the buses or other communication links.

The display device 1160 may include a display panel including a plurality of pixels, a controller, a data driver, a gate driver, an emission driver, a power supply unit, a gamma reference voltage generator, an initialization driver, and the like. Here, each of the pixels may include a pixel circuit and an organic light emitting diode, and the pixel circuit may include first to ninth transistors, a storage capacitor, and the like. The first transistor may function as a driving transistor, and the third and fourth transistors may function as a dual gate transistor. In embodiments, the eighth transistor may supply the bias power supply voltage to the first terminal of the first transistor during the activation period of the light emitting diode initialization signal, and the first transistor may be in an on-bias state. In this case, the luminance of the organic light emitting diode may not be decreased when the pixel is driven with low and middle gray levels in the low-frequency driving of the display device 1160. In addition, the ninth transistor is connected between the first node and the second terminal of the eighth transistor, a relatively voltage is applied to the first node through the ninth transistor. In this case, when the inactivation period of the compensation gate signal starts, the voltage of the first node may be prevented from increasing, and when the pixel is driven with a high gray level in the low-frequency driving of the display device 1160, the driving current may not be decreased, and the luminance of the organic light emitting diode may also not be decreased. That is, when the display device 1160 is driven at a low frequency, the display device 1160 may be driven without the decrease in the luminance of the organic light emitting diode OLED in all gray levels.

According to embodiments, the electronic device of FIG. 10 may be any electronic device including the display device 1160 such as a smart phone, a wearable electronic device, a tablet computer, a mobile phone, a television (TV), a digital TV, a 3 D TV, a personal computer (PC), a home appliance, a laptop computer, a personal digital assistant (PDA), a portable multimedia player (PMP), a digital camera, a music player, a portable game console, a navigation device, or the like.

The present disclosure may be applied to various electronic devices including a display device. For example, the present disclosure may be applied to numerous electronic devices such as vehicle-display devices, ship-display devices, aircraft-display devices, portable communication devices, exhibition display devices, information transfer display devices, medical-display devices, etc.

The foregoing is illustrative of embodiments and is not to be construed as limiting thereof Although a few embodiments have been described, those skilled in the art will readily appreciate that many modifications are possible in the embodiments without materially departing from the novel teachings and advantages of the present disclosure. Accordingly, all such modifications are intended to be included within the scope of the present disclosure as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A pixel comprising:

an organic light emitting diode configured to output a light based on a driving current, and including a first terminal and a second terminal;

a driving transistor configured to generate the driving current, and including a first terminal to which a first power supply voltage and a bias power supply voltage are applied, a second terminal connected to the first terminal of the organic light emitting diode, and a gate terminal to which a first initialization voltage is applied;

a first dual gate transistor connected between the gate terminal of the driving transistor and the second terminal of the driving transistor, and including a first sub-transistor and a second sub-transistor that are connected in series;

a first switching transistor including a first terminal to which the bias power supply voltage is applied, a second terminal connected to the first terminal of the driving transistor, and a gate terminal to which a light emitting diode initialization signal is applied; and a second switching transistor including a first terminal connected to the second terminal of the first switching transistor, a second terminal connected to a first node that connects the first and second sub-transistors to each other, and a gate terminal to which the first power supply voltage is applied.

2. The pixel of claim 1, wherein the second switching transistor is configured to reduce a voltage level of the bias power supply voltage to provide a power supply voltage, which has a voltage level that is lower than the voltage level of the bias power supply voltage, to the first node.

3. The pixel of claim 1, wherein the first switching transistor is configured to provide the bias power supply voltage to the first terminal of the driving transistor in response to the light emitting diode initialization signal, and the driving transistor to which the bias power supply voltage is applied is in an on-bias state.

4. The pixel of claim 1, wherein the first dual gate transistor includes a gate terminal to which a compensation gate signal is applied, and wherein the compensation gate signal is driven at a first frequency, the light emitting diode initialization signal is driven at a second frequency that is different from the first frequency, and the second frequency is higher than the first frequency.

5. The pixel of claim 1, further comprising a third switching transistor including a first terminal to which a second initialization voltage is applied, a second terminal connected to the first terminal of the organic light emitting diode, and a gate terminal to which the light emitting diode initialization signal is applied.

6. The pixel of claim 1, further comprising a fourth switching transistor including a first terminal to which a data voltage is applied, a second terminal connected to the first terminal of the driving transistor, and a gate terminal to which a data write gate signal is applied.

7. The pixel of claim 1, further comprising:

a storage capacitor including a first terminal to which the first power supply voltage is applied, and a second terminal connected to the gate terminal of the driving transistor;

a fifth switching transistor including a first terminal connected to a first power supply voltage line to which the first power supply voltage is applied, a second terminal connected to the first terminal of the driving transistor, and a gate terminal to which an emission signal is applied; and a sixth switching transistor including a first terminal connected to the second terminal of the driving transistor, a second terminal connected to the first terminal of the organic light emitting diode, and a gate terminal to which the emission signal is applied.

8. The pixel of claim 7, wherein the first dual gate transistor includes a gate terminal to which a compensation gate signal is applied, and the emission signal and the compensation gate signal are driven at a same frequency.

9. The pixel of claim 1, further comprising a second dual gate transistor connected between the first sub-transistor and an initialization voltage line to which the first initialization voltage is provided, and including a third sub-transistor and a fourth sub-transistor, which are connected in series.

10. The pixel of claim 9, wherein the second terminal of the second switching transistor is additionally connected to a second node that connects the third and fourth sub-transistors to each other.

11. The pixel of claim 10, wherein the second switching transistor is configured to reduce a voltage level of the bias power supply voltage to provide a power supply voltage, which has a voltage level that is lower than the voltage level of the bias power supply voltage, to the second node.

12. The pixel of claim 1, further comprising a seventh switching transistor connected between the first switching transistor and the second switching transistor, wherein the first power supply voltage is applied to a gate terminal of the seventh switching transistor.

13. The pixel of claim 12, wherein the second and seventh switching transistors are configured to reduce a voltage level of the bias power supply voltage to provide a power supply voltage, which has a voltage level that is lower than the voltage level of the bias power supply voltage, to the first node.

14. The pixel of claim 1, wherein the first dual gate transistor diode-connects the driving transistor in response to a compensation gate signal.

15. A display device comprising:

a display panel including a pixel including an organic light emitting diode configured to output a light based on a driving current, and including a first terminal and a second terminal, a driving transistor configured to generate the driving current, and including a first terminal to which a first power supply voltage and a bias power supply voltage are applied, a second terminal connected to the first terminal of the organic light emitting diode, and a gate terminal to which a first initialization voltage is applied, a first dual gate transistor connected between the gate terminal of the driving transistor and the second terminal of the driving transistor, and including a first sub-transistor and a second sub-transistor, which are connected in series, a first switching transistor including a first terminal to which the bias power supply voltage is applied, a second terminal connected to the first terminal of the driving transistor, and a gate terminal to which a light emitting diode initialization signal is applied, and a second switching transistor including a first terminal connected to the second terminal of the first switching transistor, a second terminal connected to a first node that connects the first and second sub-transistors to each other, and a gate terminal to which the first power supply voltage is applied;

a gate driver configured to generate a data write gate signal, a data initialization gate signal, and a compensation gate signal to provide the data write gate signal, the data initialization gate signal, and the compensation gate signal to the pixel, and driven at a first frequency; and an emission driver configured to generate an emission signal to provide the emission signal to the pixel, and driven at a second frequency that is different from the first frequency.

16. The display device of claim 15, further comprising an initialization driver configured to generate the light emitting diode initialization signal to provide the light emitting diode initialization signal to the pixel, and driven at the second frequency, wherein the second frequency is higher than the first frequency.

17. The display device of claim 15, wherein the pixel further includes:

a third switching transistor including a first terminal to which a second initialization voltage is applied, a second terminal connected to the first terminal of the organic light emitting diode, and a gate terminal to which the light emitting diode initialization signal is applied;

a fourth switching transistor including a first terminal to which a data voltage is applied, a second terminal connected to the first terminal of the driving transistor, and a gate terminal to which the data write gate signal is applied;

a storage capacitor including a first terminal to which the first power supply voltage is applied, and a second terminal connected to the gate terminal of the driving transistor;

a fifth switching transistor including a first terminal connected to a first power supply voltage line to which the first power supply voltage is applied, a second terminal connected to the first terminal of the driving transistor, and a gate terminal to which the emission signal is applied; and a sixth switching transistor including a first terminal connected to the second terminal of the driving transistor, a second terminal connected to the first terminal of the organic light emitting diode, and a gate terminal to which the emission signal is applied.

18. The display device of claim 15, wherein the pixel further includes a second dual gate transistor connected between the first sub-transistor and an initialization voltage line to which the first initialization voltage is provided, and including a third sub-transistor and a fourth sub-transistor, which are connected in series.

19. The display device of claim 18, wherein the second terminal of the second switching transistor is additionally connected to a second node that connects the third and fourth sub-transistors to each other.

20. The display device of claim 15, wherein the pixel further includes a seventh switching transistor connected between the first switching transistor and the second switching transistor, and the first power supply voltage is applied to a gate terminal of the seventh switching transistor.

* * * * *